US007164386B2

(12) United States Patent
Baliarda et al.

(10) Patent No.: US 7,164,386 B2
(45) **Date of Patent: *Jan. 16, 2007**

(54) SPACE-FILLING MINIATURE ANTENNAS

(75) Inventors: Carles Puente Baliarda, Barcelona (ES); Edouard Jean Louis Rozan, Barcelona (ES); Jaime Anguera Pros, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 11/154,843

(22) Filed: Jun. 16, 2005

(65) Prior Publication Data

US 2005/0231427 A1 Oct. 20, 2005

Related U.S. Application Data

(63) Continuation of application No. 10/182,635, filed as application No. PCT/EP00/00411 on Jan. 19, 2000.

(51) Int. Cl.
*H01Q 1/38* (2006.01)

(52) U.S. Cl. ..... 343/700 MS; 343/850

(58) Field of Classification Search ..... 343/700 MS, 343/895, 795, 767, 850, 853, 866
See application file for complete search history.

(56) References Cited

U.S. PATENT DOCUMENTS 3,521,284 A 7/1970 Shelton, Jr. et al.
3,599,214 A 8/1971 Altmayer
3,622,890 A 11/1971 Fujimoto et al.
3,683,376 A 8/1972 Pronovost
3,818,490 A 6/1974 Leahy
3,967,276 A 6/1976 Goubau
3,969,730 A 7/1976 Fuchser
4,021,810 A 5/1977 Urpo et al.
4,024,542 A 5/1977 Ikawa et al.
4,131,893 A 12/1978 Munson et al.
4,141,016 A 2/1979 Nelson
4,381,566 A 4/1983 Kane
4,471,358 A 9/1984 Glasser
4,471,493 A 9/1984 Schober (Continued)

FOREIGN PATENT DOCUMENTS

AU 5984099 A 4/2001

(Continued)

OTHER PUBLICATIONS

Chien-Jen Wang and Christina F. Jou, "Compact Microstrip Meander Antenna," IEEE Microwave and Optical Technology Letters, vol. 22, No. 6, pp. 413-414, Sep. 20, 1999.

(Continued)

*Primary Examiner*—Hoang V. Nguyen
(74) *Attorney, Agent, or Firm*—Howison & Arnott, L.L.P.

(57) ABSTRACT

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

23 Claims, 26 Drawing Sheets

U.S. PATENT DOCUMENTS

| | | | |
|---|---|---|---|
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,623,894 | A | 11/1986 | Lee et al. |
| 4,673,948 | A | 6/1987 | Kuo |
| 4,723,305 | A | 2/1988 | Phillips et al. |
| 4,730,195 | A | 3/1988 | Phillips et al. |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba et al. |
| 4,857,939 | A | 8/1989 | Shimazaki |
| 4,890,114 | A | 12/1989 | Egashira |
| 4,894,663 | A | 1/1990 | Urbish et al. |
| 4,907,011 | A | 3/1990 | Kuo |
| 4,912,481 | A | 3/1990 | Mace et al. |
| 4,975,711 | A | 12/1990 | Lee |
| 5,030,963 | A | 7/1991 | Tadama |
| 5,138,328 | A | 8/1992 | Zibrik et al. |
| 5,168,472 | A | 12/1992 | Lockwood |
| 5,172,084 | A | 12/1992 | Fiedzuiszko et al. |
| 5,200,756 | A | 4/1993 | Feller |
| 5,214,434 | A | 5/1993 | Hsu |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makino |
| 5,255,002 | A | 10/1993 | Day |
| 5,257,032 | A | 10/1993 | Diamond et al. |
| 5,347,291 | A | 9/1994 | Moore |
| 5,355,144 | A | 10/1994 | Walton et al. |
| 5,355,318 | A | 10/1994 | Dionnet et al. |
| 5,373,300 | A | 12/1994 | Jenness et al. |
| 5,402,134 | A | 3/1995 | Miller et al. |
| 5,420,599 | A | 5/1995 | Erkocevic |
| 5,422,651 | A | 6/1995 | Chang |
| 5,451,965 | A | 9/1995 | Matsumoto |
| 5,451,968 | A | 9/1995 | Emery |
| 5,453,751 | A | 9/1995 | Tsukamoto et al. |
| 5,457,469 | A | 10/1995 | Diamond et al. |
| 5,471,224 | A | 11/1995 | Barkeshli |
| 5,493,702 | A | 2/1996 | Crowley et al. |
| 5,495,261 | A | 2/1996 | Baker et al. |
| 5,508,709 | A | 4/1996 | Krenz et al. |
| 5,534,877 | A | 7/1996 | Sorbello et al. |
| 5,537,367 | A | 7/1996 | Lockwood et al. |
| H001631 | H | 2/1997 | Montgomery et al. |
| 5,619,205 | A | 4/1997 | Johnson |
| 5,684,672 | A | 11/1997 | Karidis et al. |
| 5,712,640 | A | 1/1998 | Andou et al. |
| 5,767,811 | A | 6/1998 | Mandai et al. |
| 5,798,688 | A | 8/1998 | Schofield |
| 5,821,907 | A | 10/1998 | Zhu et al. |
| 5,841,403 | A | 11/1998 | West |
| 5,870,066 | A | 2/1999 | Asakura et al. |
| 5,872,546 | A | 2/1999 | Ihara et al. |
| 5,898,404 | A | 4/1999 | Jou |
| 5,903,240 | A | 5/1999 | Kawahata et al. |
| 5,926,141 | A | 7/1999 | Lindenmeier et al. |
| 5,936,583 | A | 8/1999 | Sekine et al. |
| 5,943,020 | A | 8/1999 | Liebendoerfer et al. |
| 5,966,098 | A | 10/1999 | Qi et al. |
| 5,973,651 | A | 10/1999 | Suesada et al. |
| 5,986,609 | A | 11/1999 | Spall |
| 5,986,610 | A | 11/1999 | Miron |
| 5,986,615 | A | 11/1999 | Westfall et al. |
| 5,990,838 | A | 11/1999 | Burns et al. |
| 5,995,052 | A | 11/1999 | Sadler et al. |
| 6,002,367 | A | 12/1999 | Engblom et al. |
| 6,005,524 | A | 12/1999 | Hayes et al. |
| 6,028,568 | A | 2/2000 | Asakura et al. |
| 6,031,499 | A | 2/2000 | Dichter |
| 6,031,505 | A | 2/2000 | Qi et al. |
| 6,040,803 | A | 3/2000 | Spall |
| 6,069,592 | A | 5/2000 | Wass |
| 6,075,500 | A | 6/2000 | Kurz et al. |
| 6,078,294 | A | 6/2000 | Mitarai |
| 6,091,365 | A | 7/2000 | Demeryd et al. |
| 6,097,345 | A | 8/2000 | Walton |
| 6,104,349 | A | 8/2000 | Cohen |
| 6,127,977 | A | 10/2000 | Cohen |
| 6,131,042 | A | 10/2000 | Lee et al. |
| 6,140,969 | A | 10/2000 | Lindenmeier et al. |
| 6,140,975 | A | 10/2000 | Cohen |
| 6,147,652 | A | 11/2000 | Sekine |
| 6,160,513 | A | 12/2000 | Davidson et al. |
| 6,172,618 | B1 | 1/2001 | Hakozaki et al. |
| 6,181,281 | B1 | 1/2001 | Desclos et al. |
| 6,181,284 | B1 | 1/2001 | Madsen et al. |
| 6,211,824 | B1 | 4/2001 | Holden et al. |
| 6,218,992 | B1 | 4/2001 | Sadler et al. |
| 6,236,372 | B1 | 5/2001 | Lindenmeier et al. |
| 6,266,023 | B1 | 7/2001 | Nagy et al. |
| 6,272,356 | B1 | 8/2001 | Dolman et al. |
| 6,281,846 | B1 | 8/2001 | Puente Baliarda et al. |
| 6,285,342 | B1 | 9/2001 | Brady et al. |
| 6,292,154 | B1 | 9/2001 | Deguchi et al. |
| 6,300,910 | B1 | 10/2001 | Kim |
| 6,300,914 | B1 | 10/2001 | Yang |
| 6,301,489 | B1 | 10/2001 | Winstead et al. |
| 6,307,511 | B1 | 10/2001 | Ying et al. |
| 6,307,512 | B1 | 10/2001 | Geeraert |
| 6,329,951 | B1 | 12/2001 | Wen et al. |
| 6,329,954 | B1 | 12/2001 | Fuchs et al. |
| 6,329,962 | B1 | 12/2001 | Ying |
| 6,333,716 | B1 | 12/2001 | Pontoppidan |
| 6,343,208 | B1 | 1/2002 | Ying |
| 6,346,914 | B1 | 2/2002 | Annamaa |
| 6,353,443 | B1 | 3/2002 | Ying |
| 6,360,105 | B1 | 3/2002 | Nakada et al. |
| 6,367,939 | B1 | 4/2002 | Carter et al. |
| 6,373,447 | B1 | 4/2002 | Rostoker et al. |
| 6,388,626 | B1 | 5/2002 | Gamalielsson et al. |
| 6,407,710 | B1 | 6/2002 | Keilen et al. |
| 6,408,190 | B1 | 6/2002 | Ying |
| 6,417,810 | B1 | 7/2002 | Huels et al. |
| 6,417,816 | B1 | 7/2002 | Sadler et al. |
| 6,421,013 | B1 | 7/2002 | Chung |
| 6,431,712 | B1 | 8/2002 | Turnbull |
| 6,445,352 | B1 | 9/2002 | Cohen |
| 6,452,549 | B1 | 9/2002 | Lo |
| 6,452,553 | B1 | 9/2002 | Cohen |
| 6,476,766 | B1 | 11/2002 | Cohen |
| 6,483,462 | B1 | 11/2002 | Weinberger |
| 6,525,691 | B1 | 2/2003 | Varadan et al. |
| 6,552,690 | B1 | 4/2003 | Veerasamy |
| 6,784,844 | B1 | 8/2004 | Boakes et al. |
| 6,839,040 | B1 | 1/2005 | Huber et al. |
| 2001/0050636 | A1 | 12/2001 | Weinberger |
| 2002/0000940 | A1 | 1/2002 | Moren et al. |
| 2002/0000942 | A1 | 1/2002 | Duroux |
| 2002/0036594 | A1 | 3/2002 | Gyenes |
| 2002/0105468 | A1 | 8/2002 | Tessier et al. |
| 2002/0109633 | A1 | 8/2002 | Ow et al. |
| 2002/0126054 | A1 | 9/2002 | Fuerst et al. |
| 2002/0126055 | A1 | 9/2002 | Lindenmeier et al. |
| 2002/0175866 | A1 | 11/2002 | Gram |
| 2003/0090421 | A1 | 5/2003 | Sajadinia |

2005/0195112 A1* 9/2005 Baliarda et al. ..... 343/700 MS

FOREIGN PATENT DOCUMENTS

| | | | |
|---|---|---|---|
| DE | 101 42 965 | A1 | 3/2003 |
| EP | 0 843 905 | | 5/1998 |
| EP | 1 024 552 | A2 | 8/2000 |
| EP | 1 026 774 | A2 | 8/2000 |
| EP | 1 083 623 | A1 | 3/2001 |
| EP | 1 091 446 | A1 | 4/2001 |
| EP | 1 126 522 | A1 | 8/2001 |
| EP | 1 317 018 | A2 | 6/2003 |
| EP | 1 326 302 | A2 | 7/2003 |
| EP | 1 374 336 | | 1/2004 |
| EP | 1 396 906 | A1 | 3/2004 |
| EP | 1 414 106 | A1 | 4/2004 |
| EP | 1 453 140 | A1 | 9/2004 |
| ES | 200001508 | B1 | 1/2002 |
| FR | 2837339 | A1 | 9/2003 |
| GB | 2 161 026 | A | 1/1986 |
| GB | 2 293 275 | A | 3/1996 |
| GB | 2 330 951 | A | 5/1999 |
| JP | 9 199 939 | A | 7/1997 |
| SE | 5 189 88 | C2 | 12/2002 |
| WO | WO 93/12559 | A1 | 6/1993 |
| WO | WO 97/07557 | A1 | 2/1997 |
| WO | WO 99/25044 | A1 | 5/1999 |
| WO | WO 00/03167 | A1 | 1/2000 |
| WO | WO 00/65686 | A1 | 11/2000 |
| WO | WO 00/77884 | A1 | 12/2000 |
| WO | WO 01/05048 | A1 | 1/2001 |
| WO | WO 01/08254 | A1 | 2/2001 |
| WO | WO 01/08260 | A1 | 2/2001 |
| WO | WO 01/11721 | A1 | 2/2001 |
| WO | WO 01/15271 | A1 | 3/2001 |
| WO | WO 01/17063 | A1 | 3/2001 |
| WO | WO 01/20714 | A1 | 3/2001 |
| WO | WO 01/20927 | A1 | 3/2001 |
| WO | WO 01/33663 | A1 | 5/2001 |
| WO | WO 01/33664 | A1 | 5/2001 |
| WO | WO 01/35492 | A1 | 5/2001 |
| WO | WO 01/47056 | A2 | 6/2001 |
| WO | WO 01/48860 | A1 | 7/2001 |
| WO | WO 01/65636 | A1 | 9/2001 |
| WO | WO 01/86753 | A1 | 11/2001 |
| WO | WO 01/89031 | A1 | 11/2001 |
| WO | WO 02/35652 | A1 | 5/2002 |
| WO | WO 02/078121 | A2 | 10/2002 |
| WO | WO 02/078123 | A1 | 10/2002 |
| WO | WO 02/078124 | A1 | 10/2002 |
| WO | WO 02/080306 | A1 | 10/2002 |
| WO | WO 02/084790 | A1 | 10/2002 |
| WO | WO 02/095874 | A1 | 11/2002 |
| WO | WO 03/017421 | A2 | 2/2003 |
| WO | WO 03/023900 | A1 | 3/2003 |

OTHER PUBLICATIONS

H. Y. Wang and M. J. Lancaster, "Aperture-Coupled Thin-Film Superconducting Meander Antennas,", IEEE Transactions on Antennas and Propagation, vol. 47, No. 5, pp. 829-836, May 1999.

Christian Braun, Gunnar Engblom and Claes Beckman, "Antenna Diversity for Mobile Telephones," AP-S IEEE, pp. 2220-2223, Jun. 1998.

R. B. Waterhouse, D. M. Kokotoff and F. Zavosh, "Investigation of Small Printed Antennas Suitable for Mobile Communication Handsets," AP-S IEEE, pp. 1946-1949, Jun. 1998.

Terry Kin-Chung Lo and Yeongming Hwang, "Bandwidth Enhancement of PIFA Loaded with Very High Permitivity Material Using FDTD," AP-S IEEE, pp. 798-801, Jun. 1998.

Jui-Han Lu and Kai-Ping Yang, "Slot-Coupled Compact Triangular Microstrip Antenna With Lumped Load," AP-S IEEE, pp. 916-919, Jun. 1998.

Hua-Ming Chen and Kin-Lu Wong, "On the Circular Plarization Operation of Annular-Ring Microstrip Antennas," IEEE Transactions on Antennas and Propagation, vol. 47, No. 8, pp. 1289-1292, Aug. 1999.

Choon Sae Lee and Vahakn Nalbandian, "Planar Circularly Polarized Microstrip Antenna with a Single Feed," IEEE Transactions on Antennas and Propagation, vol. 47, No. 6, pp. 1005-1007, Jun. 1999.

Chih-Yu Huang, Jian-Yi Wu and Kin-Lu Wong, Cross-Slot-Coupled Microstrip Antenna and Dielectric Resonator Antenna for Circular Polarization, IEEE Transactions on Antennas and Propagation, vol. 47, No. 4, pp. 605-609, Apr. 1999.

David M. Kokotoff, James T. Aberle and Rod B. Waterhouse, "Rigorous Analysis of Probe-Fed Printed Annular Ring Antennas," IEEE Transactions on Antennas and Propagation, vol. 47, No. 2, pp. 384-388, Feb. 1999.

Rod B. Waterhouse, S. D. Targonski and D. M. Kokotoff, Design and Performance of Small Printed Antennas, IEEE Transactions on Antennas and Propagation, vol. 46, No. 11, pp. 1629-1633, Nov. 1998.

Yan Wai Chow, Edward Kai Ning Yung, Kim Fung Tsang and Hon Tat Hiu, An Innovative Monopole Antenna for Mobile-Phone Handsets, Microwave and Optical Technology Letters, vol. 25, No. 2, pp. 119-121, Apr. 20, 2000.

Wen-Shyang Chen, "Small Circularly Polarized Microstrip Antennas," AP-S IEEE, pp. 1-3, Jul. 1999.

K. W. Lam and Edward K. N. Yung, "A Novel Leaky Wave Antenna for the Base Station in an Innovative Indoors Cellular Mobile Communication System," AP-S IEEE, Jul. 1999.

H. Iwasaki, "A Circularly Polarized Small-Size Microstrip Antenna with a Cross Slot," IEEE Transactions on Antennas and Propagation, vol. 44, No. 10, pp. 1399-1401, Oct. 1996.

Choon Sae Lee and Pi-Wei Chen, "Electrically Small Microstrip Antennas," IEEE, 2000.

Jui-Han Lu, Chia-Luan Tang and Kin-Lu Wong, "Slot-Coupled Small Triangular Microstrip Antenna," Microwave and Optical Technology Letters, vol. 16, No. 6, pp. 371-374, Dec. 20, 1997.

Chia-Luan Tang, Hong-Twu Chen and Kin-Lu Wong, "Small Circular Microstrip Antenna with Dual-Frequency Operation," IEEE Electronic Letters, vol. 33, pp. 1112-1113, Jun. 10, 1997.

R. Waterhouse, "Small Microstrip Patch Antenna," IEEE Electronic Letters, vol. 31, pp. 604-605, Feb. 21, 1995.

R. Waterhouse, "Small Printed Antenna Easily Integrated Into a Mobile Handset Terminal,"IEEE Electronic Letters,vol. 34, No. 17, pp. 1629-1631, Aug. 20, 1998.

O. Leisten, Y. Vardaxoglou, T. Schmid, B. Rosenberger, E. Agboraw, N. Kuster and G. Nicolaidis, "Miniature Dielectric-Loaded Personal Telephone Antennas with Low User Exposure," IEEE Electronic Letters, vol. 34, No. 17, pp. 1628-1629, Aug. 20, 1998.

Hua-Ming Chen, "Dual-Frequency Microstrip Antenna with Embedded Reactive Loading," IEEE Microwave and Optical Technology Letters, vol. 23, No. 3, pp. 186-188, Nov. 5, 1999.

Shyh-Timg Fang and Kin-Lu Wong, "A Dual Frequency Equilateral-Triangular Microstrip Antenna with a Pair of Narrow Slots," IEEE Microwave and Optical Technology Letters, vol. 23, No. 2, pp. 82-84, Oct. 20, 1999.

Kin-Lu Wong and Kai-Ping Yang, "Modified Planar Inverted F Antenna,"IEEE Electronic Letters, vol. 34, No. 1, pp. 7-8, Jan. 8, 1998.

S. K. Palit, A. Hamadi and D. Tan, "Design of a Wideband Dual-Frequency Notched Microstrip Antenna," AP-S IEEE, pp. 2351-2354, Jun. 1998.

T. Williams, M. Rahman and M. A. Stuchly, "Dual-Band Meander Antenna for Wireless Telephones," IEEE Microwave and Optical Technology Letters, vol. 24, No. 2, pp. 81-85, Jan. 20, 2000.

Nathan Cohen, "Fractal Antennas, Part 1," Communications Quarterly: The Journal of Communications Technology, pp. 7-22, Summer, 1995.

Nathan Cohen, "Fractal and Shaped Dipoles," Communications Quarterly: The Journal of Communications Technology, pp. 25-36, Spring 1995.

Nathan Cohen, "Fractal Antennas, Part 2," Communications Quarterly: The Journal of Communications Technology, pp. 53-66, Summer 1996.

John P. Gianvittorio and Yahya Rahmat-Samii, Fractal Element Antennas: A Compilation of Configurations with Novel Characteristics, IEEE, 2000.

Jacob George, C. K. Aanandan, P. Mohanan and K. G. Nair, "Analysis of a New Compact Microstrip Antenna," IEEE Transactions on Antennas and Propagation, vol. 46, No. 11, pp. 1712-1717, Nov. 1998.

Jungmin Chang and Sangseol Lee, "Hybrid Fractal Cross Antenna," IEEE Microwave and Optical Technology Letters, vol. 25, No. 6, pp. 429-435, Jun. 20, 2000.

Jaume Anguera, Carles Puente, Carmen Borja, Jordi Romeu and Marc Aznar, "Antens Microstrip Apiladas con Geometria de Anillo," Proceedings of the XIII National Symposium of the Scientific International Union of Radio, URSI '00, Zaragoza, Spain, Sep. 2000. English Abstract.

C. Puente, J. Romeu, R. Pous, J. Ramis and A. Hijazo, "La Antena de Koch: Un Monopolo Largo Pero Pequeño," XIII Simposium Nacional URSI, vol. I, pp. 371-373, Pamplona, Sep. 1998, English Abstract.

C. Puente and R. Pous, "Diseño Fractal de Agrupaciones de Antenas," IX Simposium Nacional URSI, Viol. I, pp. 227-231, Las Palmas, Sep. 1994. English Abstract.

C. Puente, J. Romeu, R. Pous and A. Cardama, "Multiband Fractal Antennas and Arrays," Fractals in Engineering, J. L. Véhel, E. Lutton, C. Tricot editors, Springer, New York, pp. 222-236, 1997.

C. Puente and R. Pous, "Fractal Design of Multiband and Low Side-Lobe Arrays," IEEE Transactions on Antennas and Propagation, vol. 44, No. 5, pp. 730-739, May 1996.

E. A. Parker and A. N. A. El.Sheikh; Convoluted Dipole Array Elements; Electronics Letters; Feb. 14. 1991; pp. 322-333; vol. 27, No. 4; IEE; United Kingdom.

Dr. Carles Puente Baliarda; Fractal Antennas; Ph.D. Dissertation; May 1997; Cover page—p. 270; Electromagnetics and Photonics Engineering group, Dept. of Signal Theory and Communications, Universitat Poltécnica de Catalunya; Barcelona, Spain.

Oscar Campos Escala; Study of Multiband and Miniature Fractal Antennas; Final Year Project; Cover p. 119 plus translation; Superior Technical Engineering School of Telecommunications, Barcelona Polytechnic University, Barcelona, Spain, date not available.

Oriol Verdura Contreras; Fractal Miniature Antenna; Final Year Project; Sep. 1997; Cover p. 61 plus translation; UPC Baix Llobregat Polytechnic University; Barcelona, Spain.

Carmen Borja Borau; Antenas Fractales Microstrip (Microstrip Fractal Antennas); Thesis; 1997;Cover page—Biblografia p. 3 (261 pages); E.T.S. d'Enginyeria de Telecomunicacio; Barcelona, Spain. Note: English Language Translation for Document Attached to 5th Supp IDS.

* cited by examiner

SPACE-FILLING MINIATURE ANTENNAS

This application is a continuation of Ser. No. 10/182,635 filed on Nov. 1,2002, now abandoned, which is a 371 of PCT/EP00/00411 filed on Jan. 19, 2000.

OBJECT OF THE INVENTION

The present invention generally refers to a new family of antennas of reduced size based on an innovative geometry, the geometry of the curves named as Space-Filling Curves (SFC). An antenna is said to be a small antenna (a miniature antenna) when it can be fitted in a small space compared to the operating wavelength. More precisely, the radiansphere is taken as the reference for classifying an antenna as being small. The radiansphere is an imaginary sphere of radius equal to the operating wavelength divided by two times $\pi$; an antenna is said to be small in terms of the wavelength when it can be fitted inside said radiansphere.

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

The invention is applicable to the field of the telecommunications and more concretely to the design of antennas with reduced size.

BACKGROUND AND SUMMARY OF THE INVENTION

The fundamental limits on small antennas where theoretically established by H. Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental derived in such theory imposes a maximum bandwidth given a specific size of an small antenna.

Related to this phenomenon, it is also known that a small antenna features a large input reactance (either capacitive or inductive) that usually has to be compensated with an external matching/loading circuit or structure. It also means that is difficult to pack a resonant antenna into a space which is small in terms of the wavelength at resonance. Other characteristics of a small antenna are its small radiating resistance and its low efficiency.

Searching for structures that can efficiently radiate from a small space has an enormous commercial interest, especially in the environment of mobile communication devices (cellular telephony, cellular pagers, portable computers and data handlers, to name a few examples), where the size and weight of the portable equipments need to be small. According to R. C. Hansen (R. C. Hansen, "Fundamental Limitations on Antennas," Proc. IEEE, vol. 69, no. 2, February 1981), the performance of a small antenna depends on its ability to efficiently use the small available space inside the imaginary radiansphere surrounding the antenna.

In the present invention, a novel set of geometries named Space-Filling Curves (hereafter SFC) are introduced for the design and construction of small antennas that improve the performance of other classical antennas described in the prior art (such as linear monopoles, dipoles and circular or rectangular loops).

Some of the geometries described in the present invention are inspired in the geometries studied already in the XIX century by several mathematicians such as Giusepe Peano and David Hilbert. In all said cases the curves were studied from the mathematical point of view but were never used for any practical engineering application.

The dimension (D) is often used to characterize highly complex geometrical curves and structures such those described in the present invention. There exists many different mathematical definitions of dimension but in the present document the box-counting dimension (which is well-known to those skilled in mathematics theory) is used to characterize a family of designs. Those skilled in mathematics theory will notice that optionally, an Iterated Function System (IFS), a Multireduction Copy Machine (MRCM) or a Networked Multireduction Copy Machine (MRCM) algorithm can be used to construct some space-filling curves as those described in the present invention.

The key point of the present invention is shaping part of the antenna (for example at least a part of the arms of a dipole, at least a part of the arm of a monopole, the perimeter of the patch of a patch antenna, the slot in a slot antenna, the loop perimeter in a loop antenna, the horn cross-section in a horn antenna, or the reflector perimeter in a reflector antenna) as a space-filling curve, that is, a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the structure of a miniature antenna according to the present invention, the segments of the SFC curves must be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, It is usually understood that a curve is always a one-dimension object; however when the curve is highly convoluted and its physical length is very large, the curve tends to fill parts of the surface which supports it; in that case the Haussdorf dimension can be computed over the curve (or at least an approximation of it by means of the box-counting algorithm) resulting in a number larger than unity. Such theoretical infinite curves can not be physically constructed, but they can be approached with SFC designs. The curves 8 and 17 described in and FIG. 2 and FIG. 5 are some examples of such SFC, that approach an ideal infinite curve featuring a dimension D=2.

The advantage of using SFC curves in the physical shaping of the antenna is two-fold:

(a) Given a particular operating frequency or wavelength said SFC antenna can be reduced in size with respect to prior art.

(b) Given the physical size of the SFC antenna, said SFC antenna can be operated at a lower frequency (a longer wavelength) than prior art.

DETAILED DESCRIPTION OF THE PREFERRED EMBODIMENTS

Figure 1:
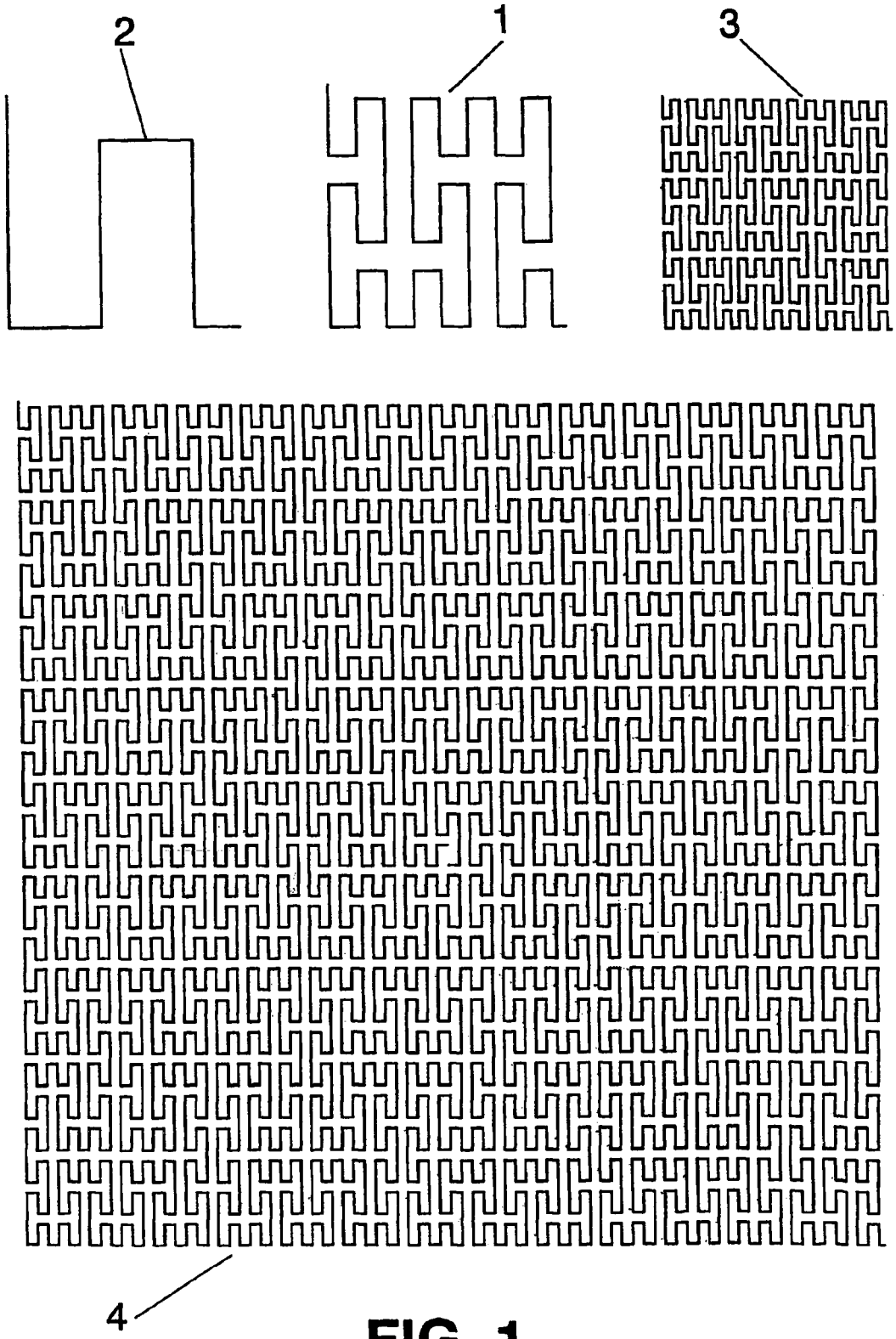
FIG. 1 shows some particular cases of SFC curves. From an initial curve (2), other curves (1), (3) and (4) with more than 10 connected segments are formed. This particular family of curves are named hereafter SZ curves.
Figure 2:
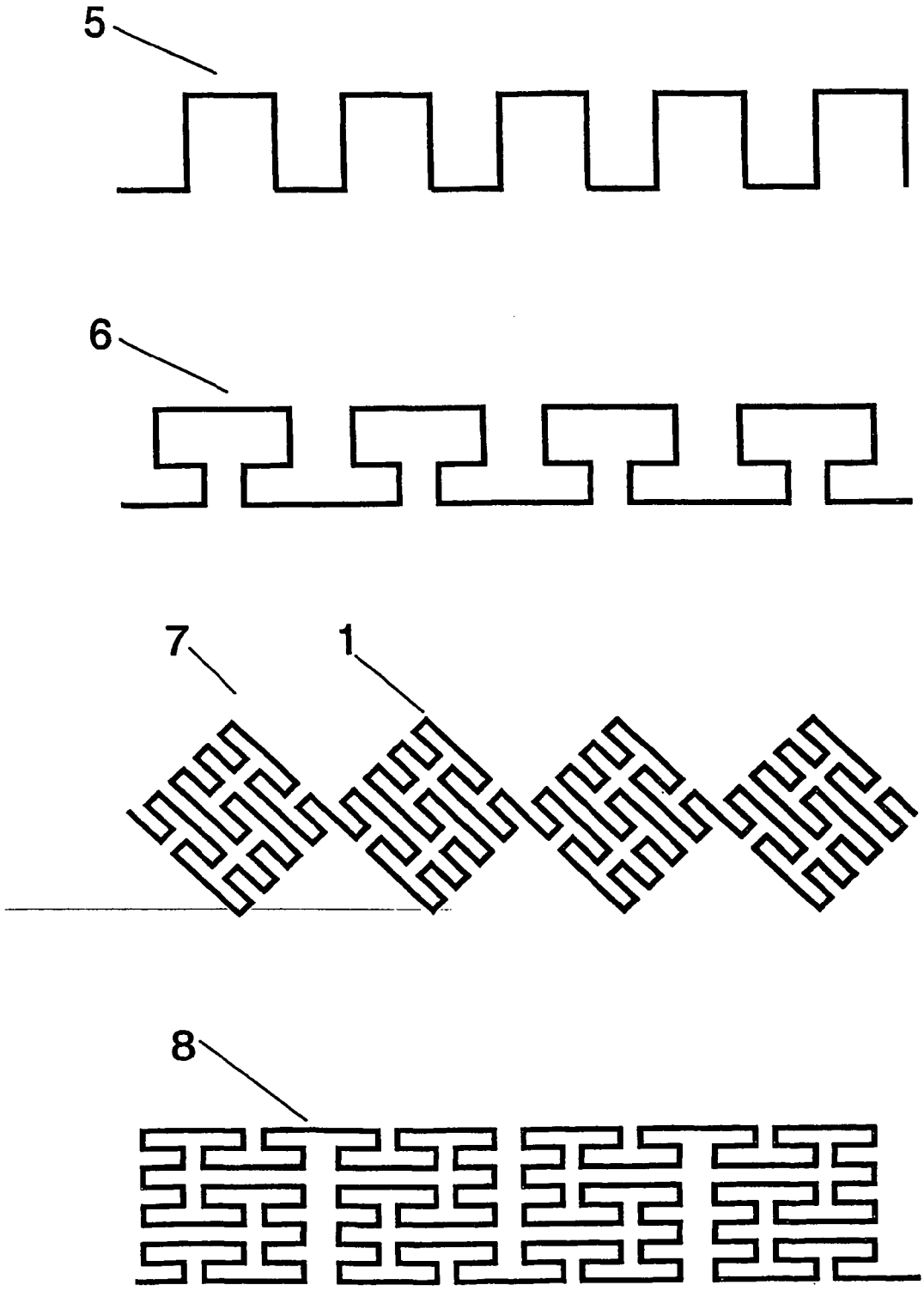
FIG. 2 shows a comparison between two prior art meandering lines and two SFC periodic curves, constructed from the SZ curve of drawing 1.

FIG. 1 and FIG. 2 show some examples of SFC curves. Drawings (1), (3) and (4) in FIG. 1 show three examples of SFC curves named SZ curves. A curve that is not an SFC since it is only composed of 6 segments is shown in drawing (2) for comparison. The drawings (7) and (8) in FIG. 2 show another two particular examples of SFC curves, formed from the periodic repetition of a motive including the SFC curve (1). It is important noticing the substantial difference between these examples of SFC curves and some examples of periodic, meandering and not SFC curves such as those in drawings (5) and (6) in FIG. 2. Although curves (5) and (6) are composed by more than 10 segments, they can be substantially considered periodic along a straight direction (horizontal direction) and the motive that defines a period or repetition cell is constructed with less than 10 segments (the period in drawing (5) includes only four segments, while the period of the curve (6) comprises nine segments) which contradicts the definition of SFC curve introduced in the present invention. SFC curves are substantially more complex and pack a longer length in a smaller space; this fact in conjunction with the fact that each segment composing and SFC curve is electrically short (shorter than a tenth of the free-space operating wavelength as claimed in this invention) play a key role in reducing the antenna size. Also, the class of folding mechanisms used to obtain the particular SFC curves described in the present invention are important in the design of miniature antennas.

Figure 3:
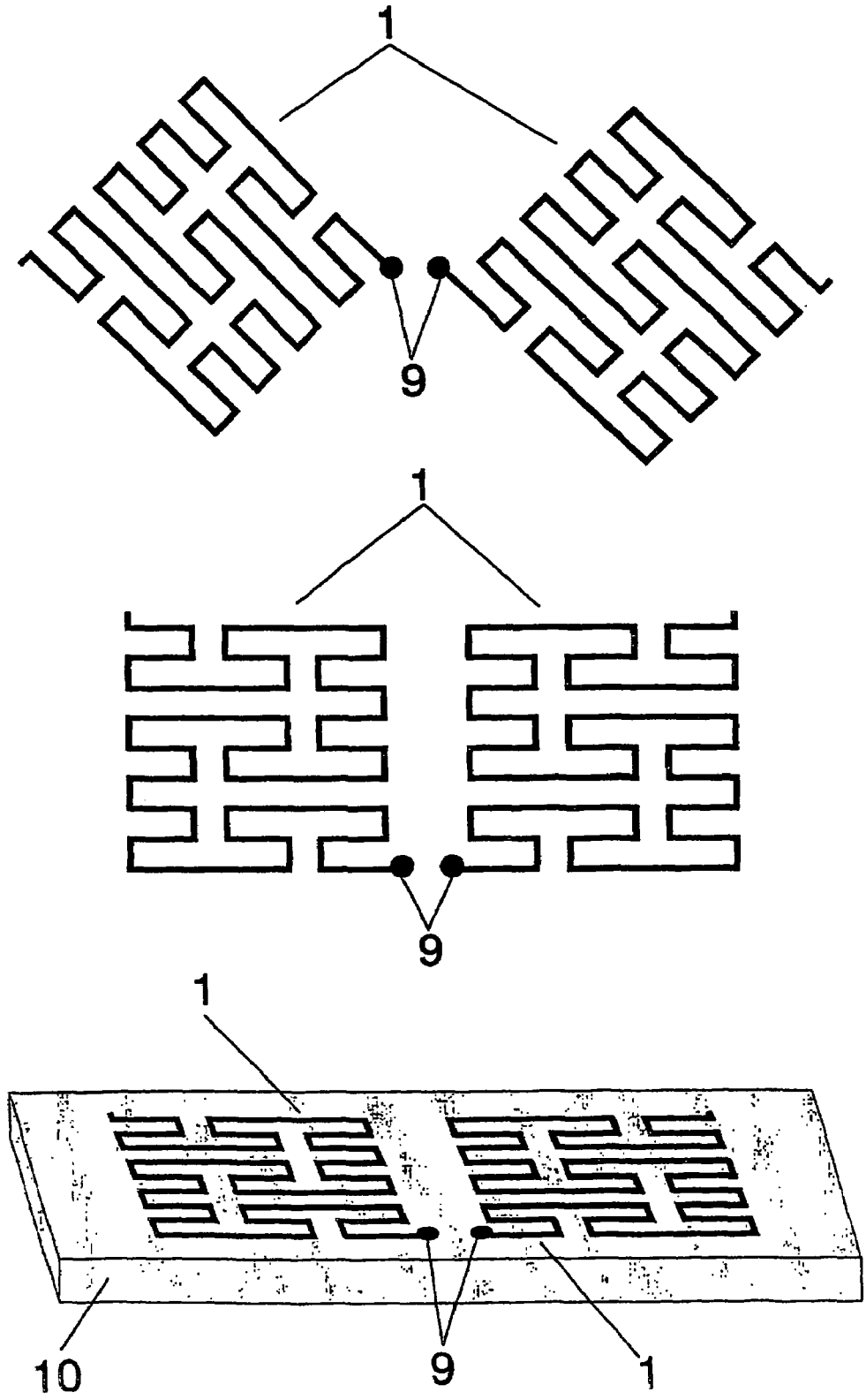
FIG. 3 shows a particular configuration of an SFC antenna. It consists on tree different configurations of a dipole wherein each of the two arms is fully shaped as an SFC curve (1).

FIG. 3 describes a preferred embodiment of an SFC antenna. The three drawings display different configurations of the same basic dipole. A two-arm antenna dipole is constructed comprising two conducting or superconducting parts, each part shaped as an SFC curve. For the sake of clarity but without loss of generality, a particular case of SFC curve (the SZ curve (1) of FIG. 1) has been chosen here; other SFC curves as for instance, those described in FIGS. 1, 2, 6, 8, 14, 19, 20, 21, 22, 23, 24 or 25 could be used instead. The two closest tips of the two arms form the input terminals (9) of the dipole. The terminals (9) have been drawn as conducting or superconducting circles, but as it is clear to those skilled in the art, such terminals could be shaped following any other pattern as long as they are kept small in terms of the operating wavelength. Also, the arms of the dipoles can be rotated and folded in different ways to finely modify the input impedance or the radiation properties of the antenna such as, for instance, polarization. Another preferred embodiment of an SFC dipole is also shown in FIG. 3, where the conducting or superconducting SFC arms are printed over a dielectric substrate (10); this method is particularly convenient in terms of cost and mechanical robustness when the SFC curve is long. Any of the well-known printed circuit fabrication techniques can be applied to pattern the SFC curve over the dielectric substrate. Said dielectric substrate can be for instance a glass-fibre board, a teflon based substrate (such as Cuclad®) or other standard radiofrequency, and microwave substrates (as for instance Rogers 4003® or Kapton®). The dielectric substrate can even be a portion of a window glass if the antenna is to be mounted in a motor vehicle such as a car, a train or an air-plane, to transmit or receive radio, TV, cellular telephone (GSM 900, GSM 1800, UMTS) or other communication services electromagnetic waves. Of course, a balun network can be connected or integrated at the input terminals of the dipole to balance the current distribution among the two dipole arms.

Figure 4:
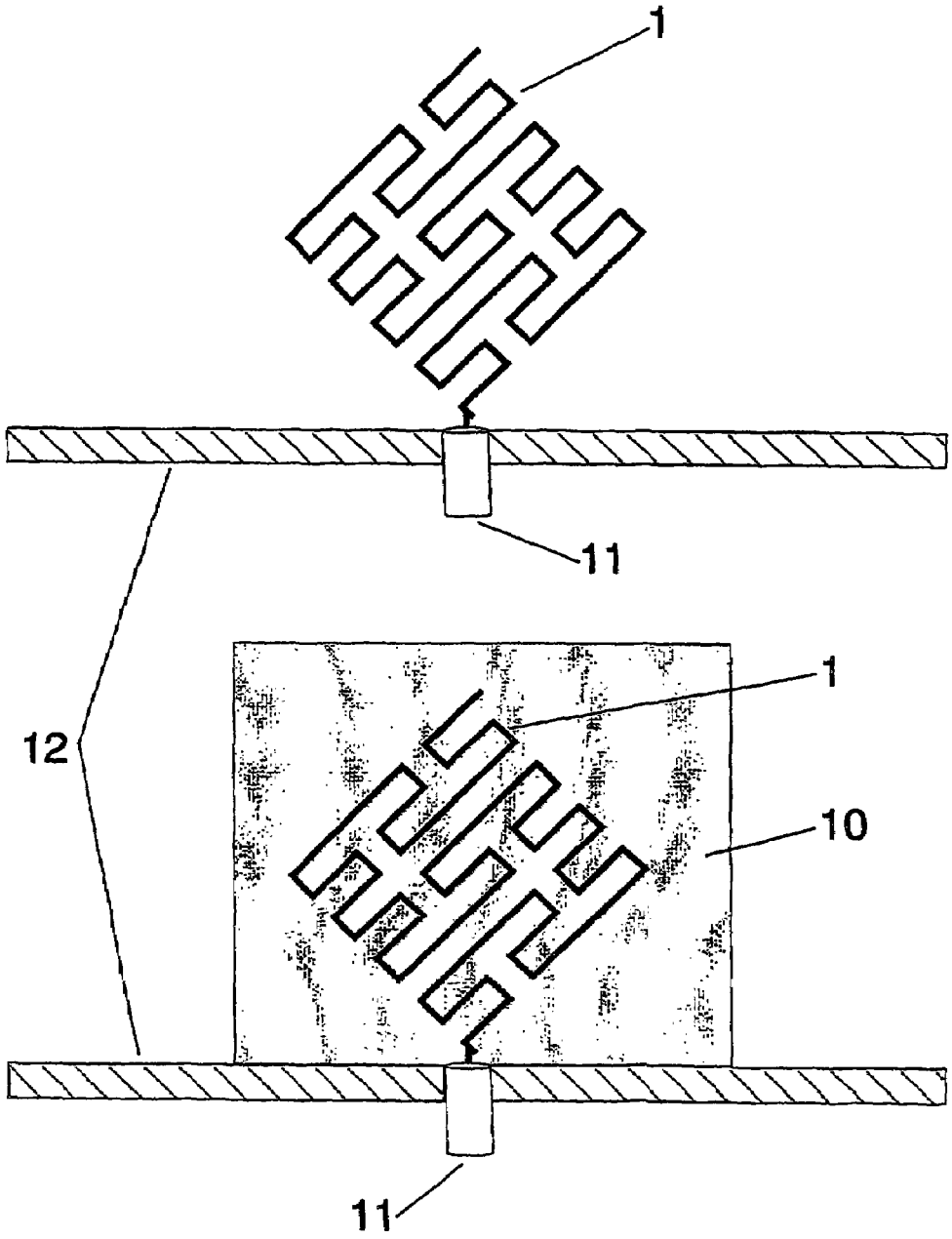
FIG. 4 shows other particular cases of SFC antennas. They consist on monopole antennas.

Another preferred embodiment of an SFC antenna is a monopole configuration as shown in FIG. 4. In this case one of the dipole arms is substituted by a conducting or superconducting counterpoise or ground plane (12). A handheld telephone case, or even a part of the metallic structure of a car, train or can act as such a ground counterpoise. The ground and the monopole arm (here the arm is represented with SFC curve (1), but any other SFC curve could be taken instead) are excited as usual in prior art monopoles by means of, for instance, a transmission line (11). Said transmission line is formed by two conductors, one of the conductors is connected to the ground counterpoise while the other is connected to a point of the SFC conducting or superconducting structure. In the drawings of FIG. 4, a coaxial cable (11) has been taken as a particular case of transmission line, but it is clear to any skilled in the art that other transmission lines (such as for instance a microstrip arm) could be used to excite the monopole. Optionally, and following the scheme described in FIG. 3, the SFC curve can be printed over a dielectric substrate (10).

Figure 5:
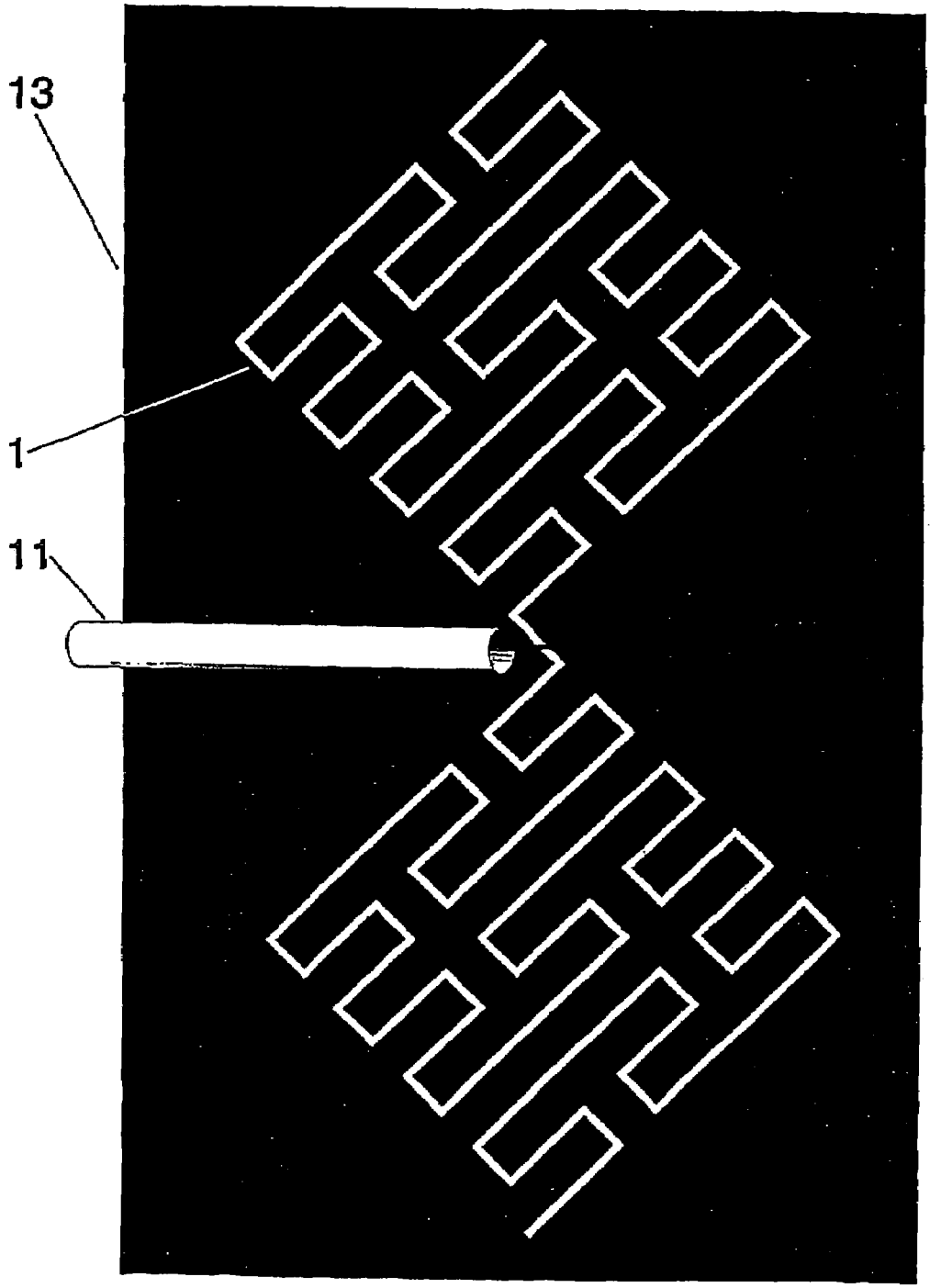
FIG. 5 shows an example of an SFC slot antenna where the slot is shaped as the SFC in drawing 1.
Figure 6:
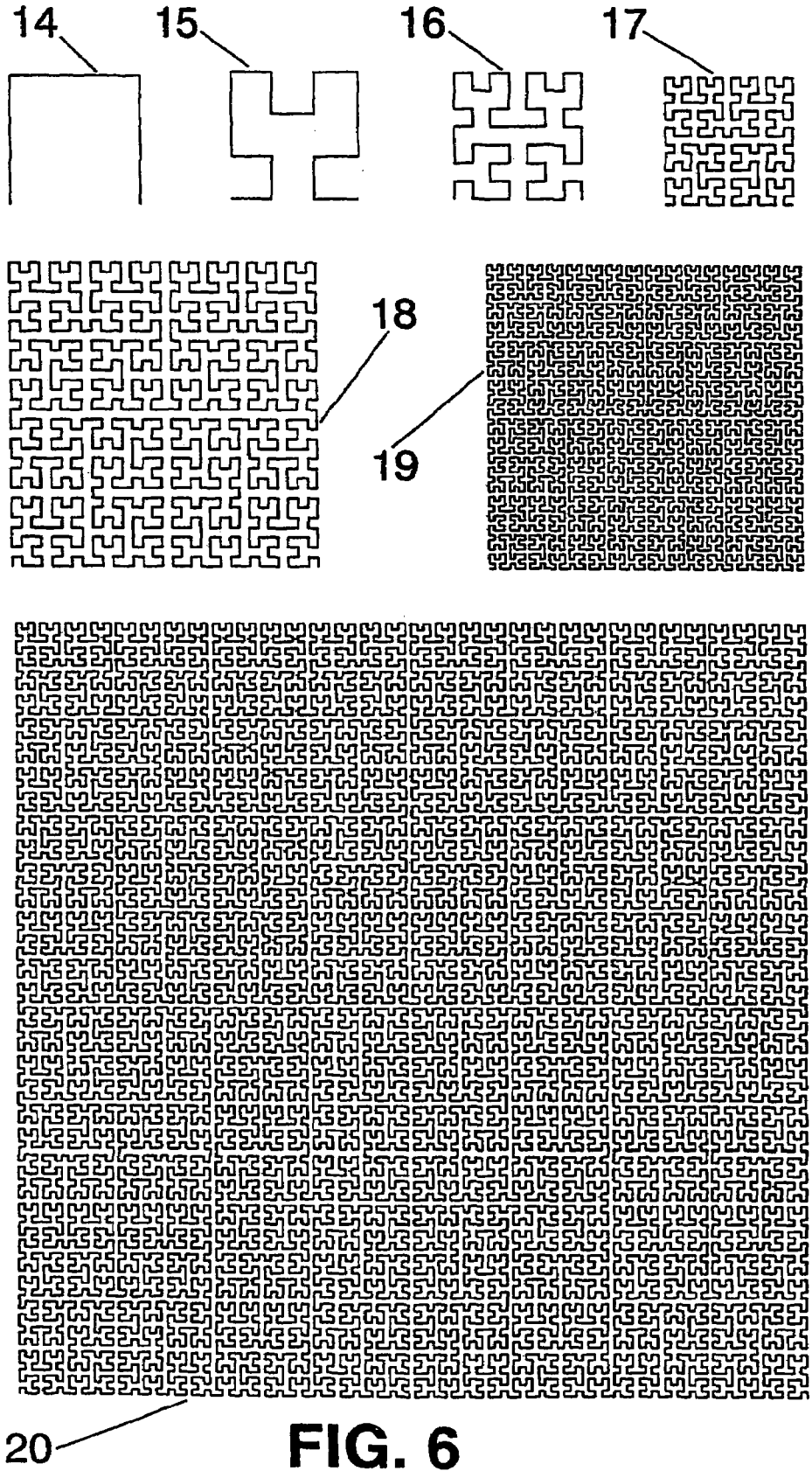
FIG. 6 shows another set of SFC curves (15–20) inspired on the Hilbert curve and hereafter named as Hilbert curves. A standard, non-SFC curve is shown in (14) for comparison.
Figure 7:
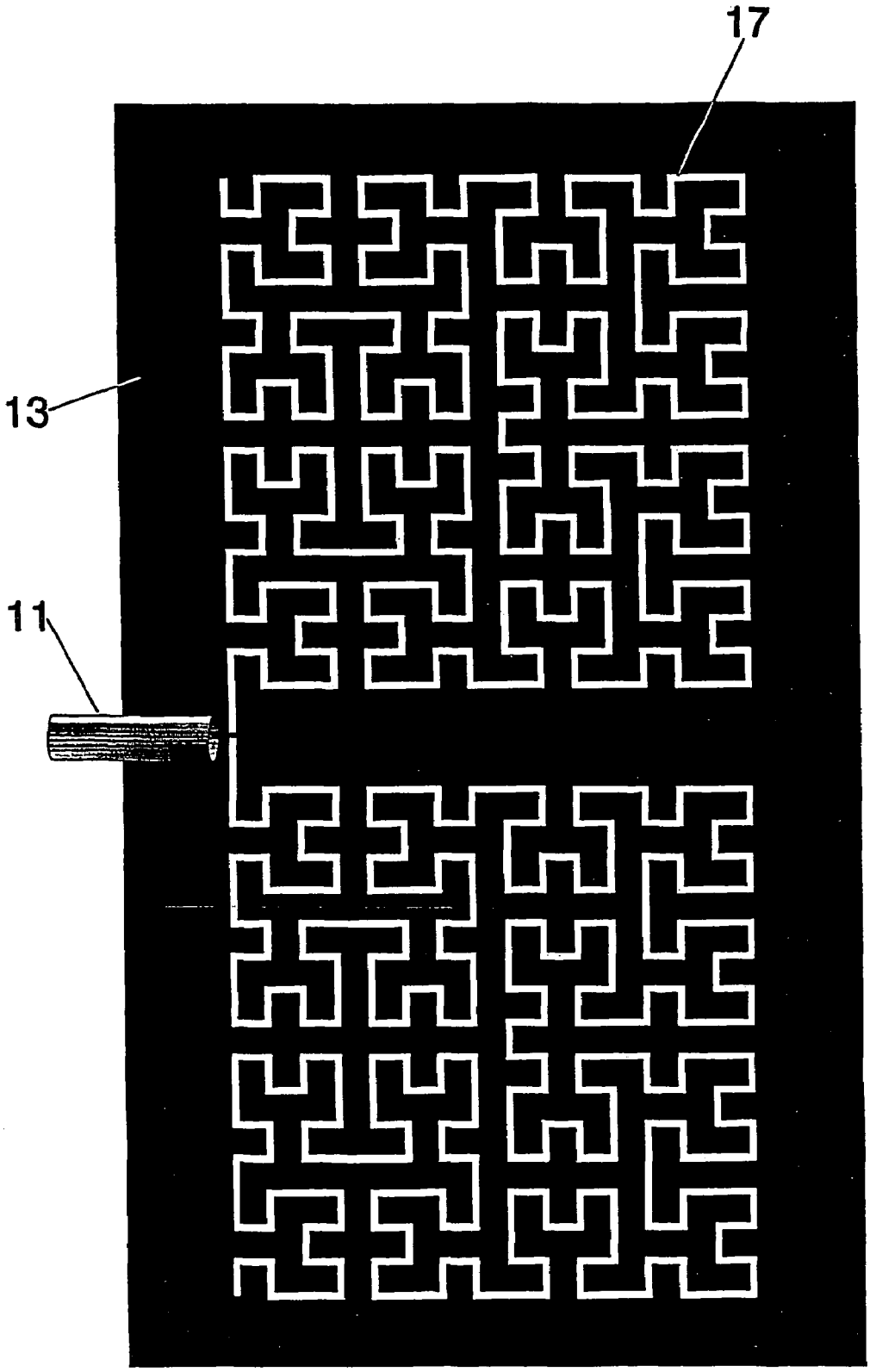
FIG. 7 shows another example of an SFC slot antenna based on the SFC curve (17) in drawing 6.
Figure 8:
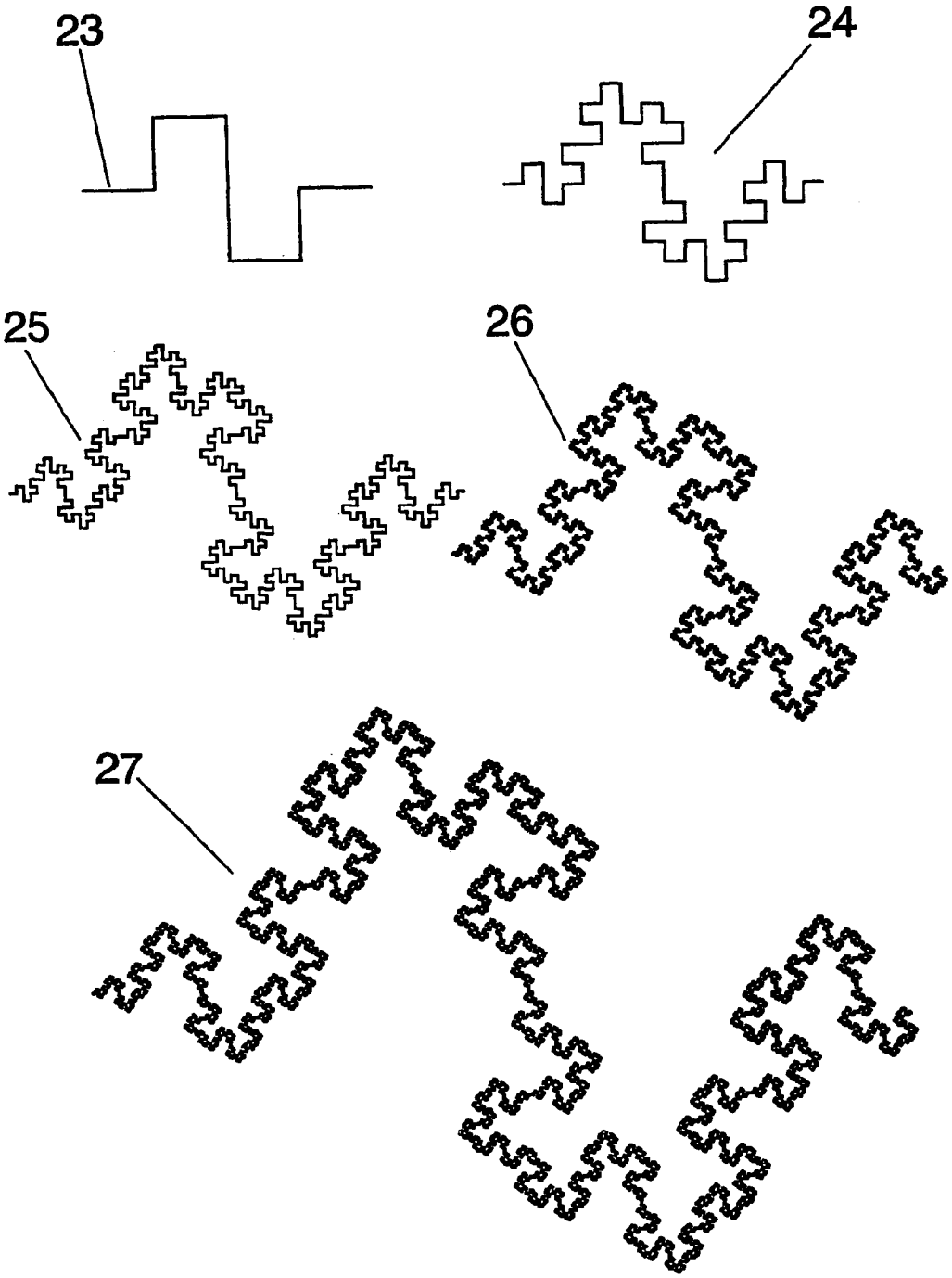
FIG. 8 shows another set of SFC curves (24, 25, 26, 27) hereafter known as ZZ curves. A conventional squared zigzag curve (23) is shown for comparison.
Figure 10:
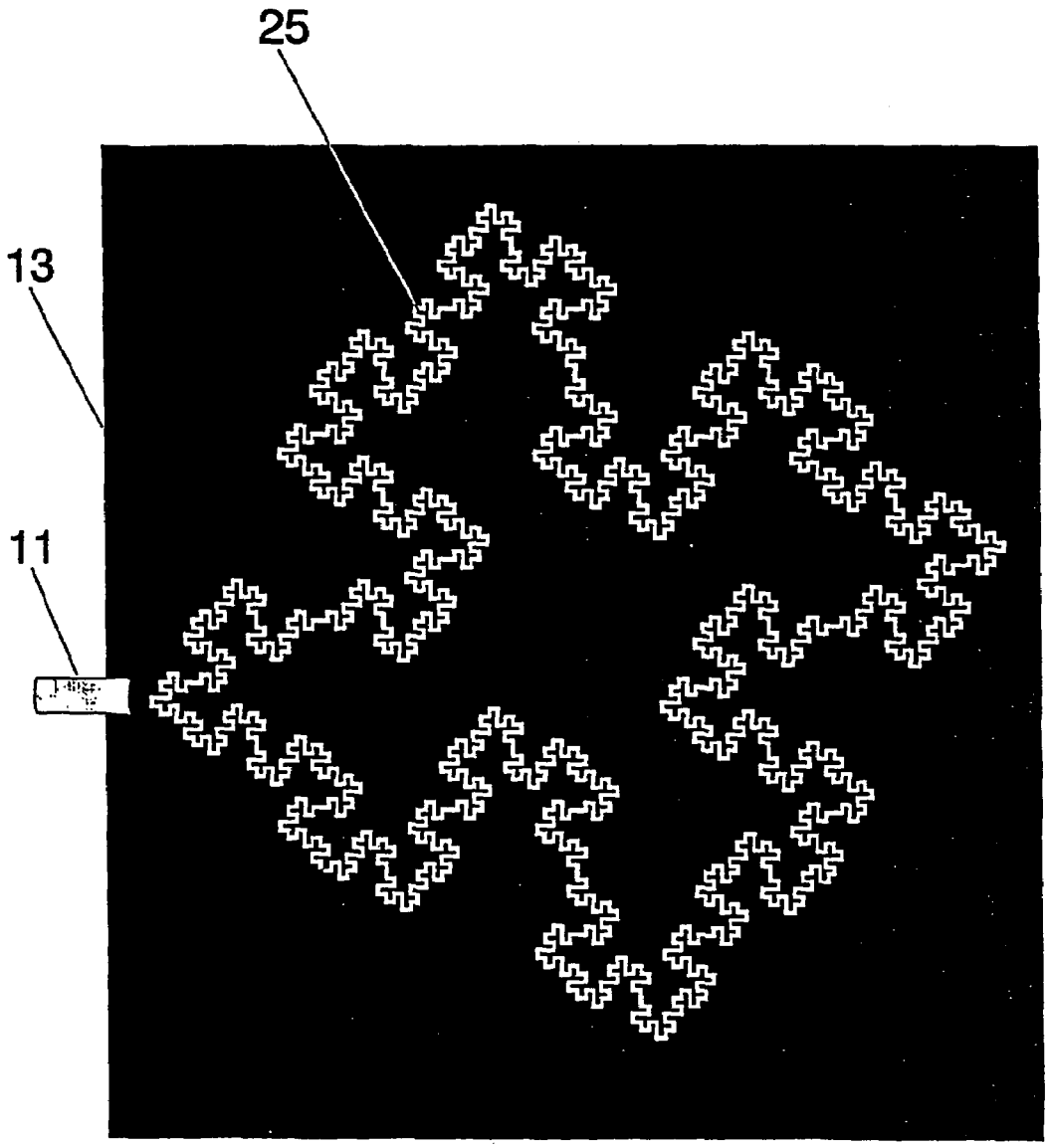
FIG. 10 shows a slot loop antenna based on the SFC (25) in drawing 8.

Another preferred embodiment of an SFC antenna is a slot antenna as shown, for instance in FIGS. 5, 7 and 10. In FIG. 5, two connected SFC curves (following the pattern (1) of FIG. 1) form an slot or gap impressed over a conducting or superconducting sheet (13). Such sheet can be, for instance, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or airplane. The exciting scheme can be any of the well known in conventional slot antennas and it does not become an essential part of the present invention. In all said three figures, a coaxial cable (11) has been used to excite the antenna, with one of the conductors connected to one side of the conducting sheet and the other one connected at the other side of the sheet across the slot. A microstrip transmission line could be used, for instance, instead of the coaxial cable.

To illustrate that several modifications of the antenna that can be done based on the same principle and spirit of the present invention, a similar example is shown in FIG. 7, where another curve (the curve (17) from the Hilbert family) is taken instead. Notice that neither in FIG. 5, nor in FIG. 7 the slot reaches the borders of the conducting sheet, but in another embodiment the slot can be also designed to reach the boundary of said sheet, breaking said sheet in two separate conducting sheets.

FIG. 10 describes another possible embodiment of an slot SFC antenna. It is also an slot antenna in a closed loop configuration the loop is constructed for instance by connecting four SFC gaps following the pattern of SFC (25) in FIG. 8 (it is clear that other SFC curves could be used instead according to the spirit and scope of the present invention). The resulting closed loop determines the boundary of a conducting or superconducting island surrounded by a conducting or superconducting sheet. The slot can be excited by means of any of the well-known conventional techniques; for instance a coaxial cable (11) can be used, connecting one of the outside conductor to the conducting outer sheet and the inner conductor to the inside conducting island surrounded by the SFC gap. Again, such sheet can be, for example, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or air-plane. The slot can be even formed by the gap between two close but not co-planar conducting island and conducting sheet; this can be physically implemented for instance by mounting the inner conducting island over a surface of the optional dielectric substrate, and the surrounding conductor over the opposite surface of said substrate.

Figure 9:
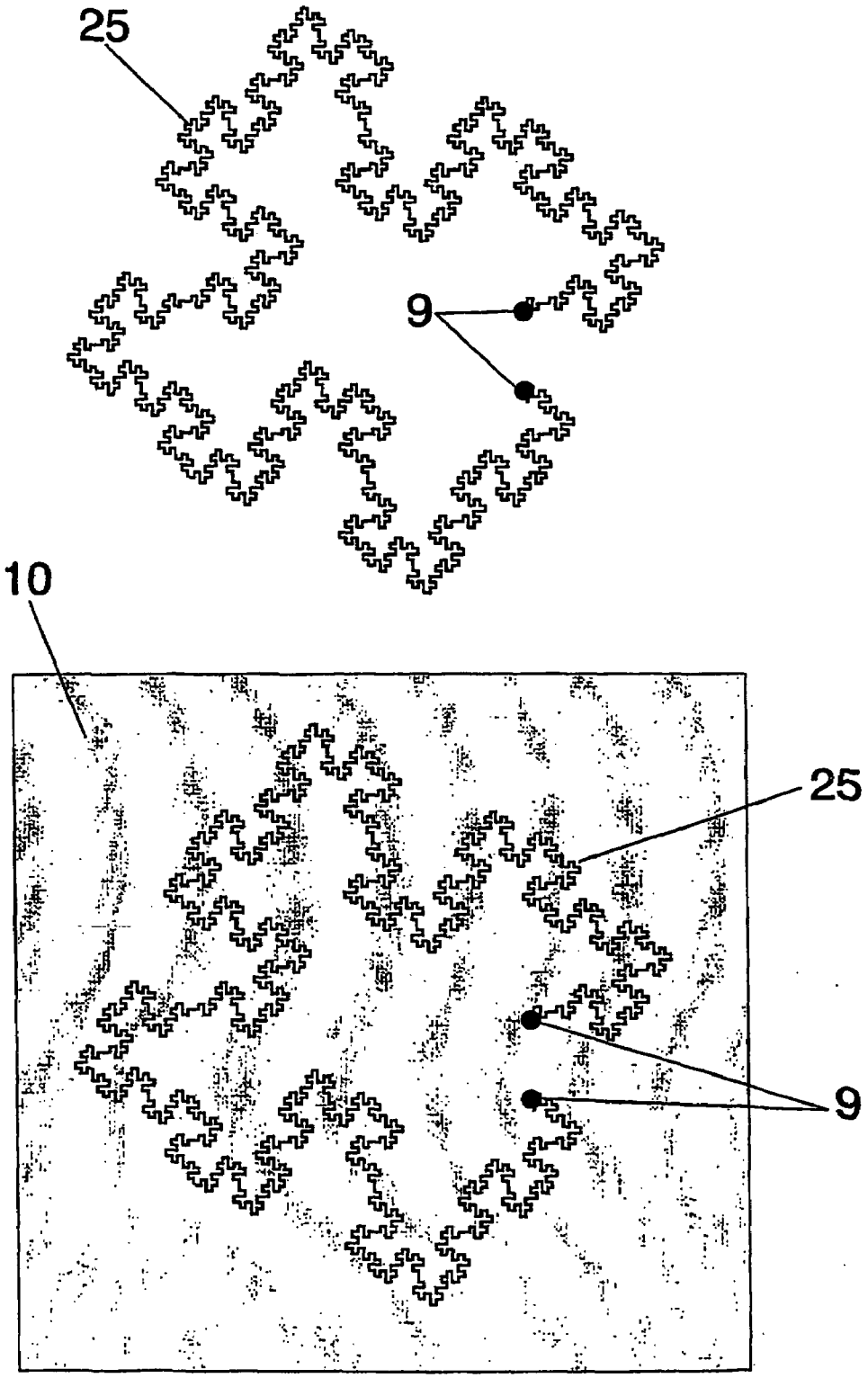
FIG. 9 shows a loop antenna based on curve (25) in a wire configuration (top). Below, the loop antenna 29 is printed over a dielectric substrate (10).

The slot configuration is not, of course, the only way of implementing an SFC loop antenna. A closed SFC curve made of a superconducting or conducting material can be used to implement a wire SFC loop antenna as shown in another preferred embodiment as that of FIG. 9. In this case, a portion of the curve is broken such as the two resulting ends of the curve form the input terminals (9) of the loop. Optionally, the loop can be printed also over a dielectric substrate (10). In case a dielectric substrate is used, a dielectric antenna can be also constructed by etching a dielectric SFC pattern over said substrate, being the dielectric permitivity of said dielectric pattern higher than that of said substrate.

Figure 11:
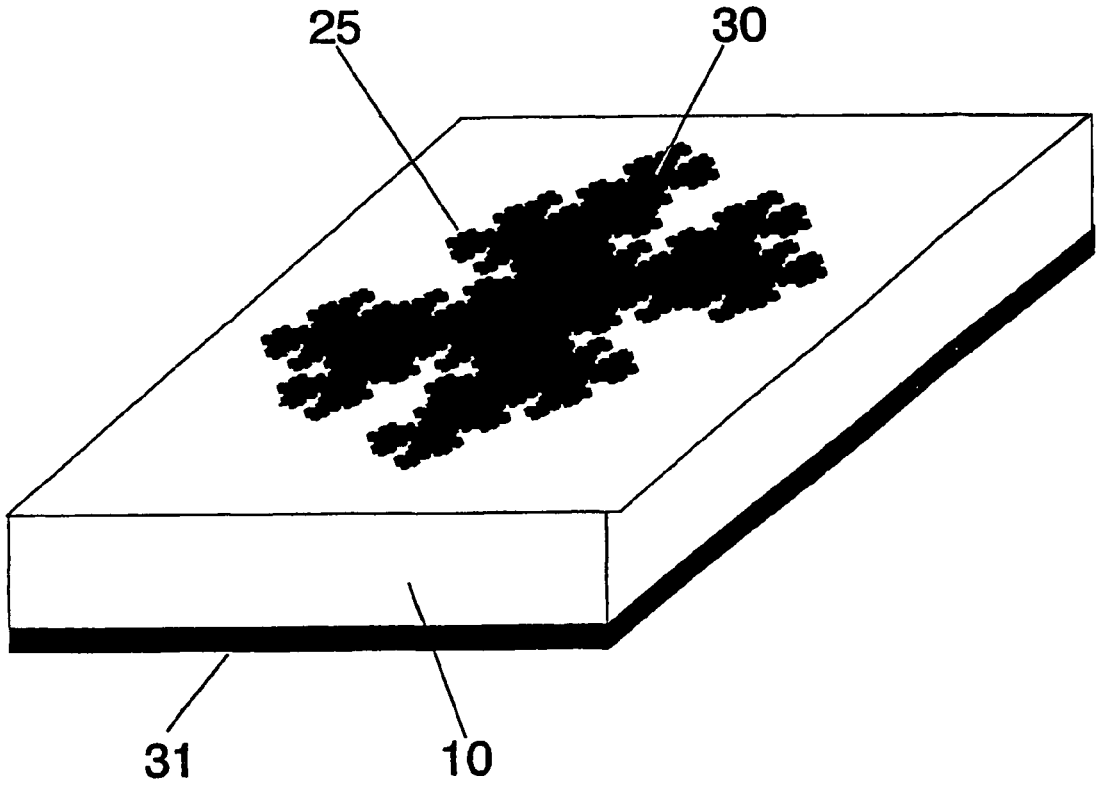
FIG. 11 shows a patch antenna wherein the patch perimeter is shaped according to SFC (25).

Another preferred embodiment is described in FIG. 11. It consists on a patch antenna, with the conducting or superconducting patch (30) featuring an SFC perimeter (the particular case of SFC (25) has been used here but it is clear that other SFC curves could be used instead). The perimeter of the patch is the essential part of the invention here, being the rest of the antenna conformed, for example, as other conventional patch antennas: the patch antenna comprises a conducting or superconducting ground-plane (31) or ground counterpoise, an the conducting or superconducting patch which is parallel to said ground-plane or ground-counterpoise. The spacing between the patch and the ground is typically below (but not restricted to) a quarter wavelength. Optionally, a low-loss dielectric substrate (10) (such as glass-fibre, a teflon substrate such as Cuclad® or other commercial materials such as Rogers® 4003) can be place between said patch and ground counterpoise. The antenna feeding scheme can be taken to be any of the well-known schemes used in prior art patch antennas, for instance: a coaxial cable with the outer conductor connected to the ground-plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on can be used as well); a microstrip transmission line sharing the same ground-plane as the antenna with the strip capacitively coupled to the patch and located at a distance below the patch, or in another embodiment with the strip placed below the ground-plane and coupled to the patch through an slot, and even a microstrip transmission line with the strip co-planar to the patch. All these mechanisms are well known from prior art and do not constitute an essential part of the present invention. The essential part of the present invention is the shape of the antenna (in this case the SFC perimeter of the patch) which contributes to reducing the antenna size with respect to prior art configurations.

Figure 13:
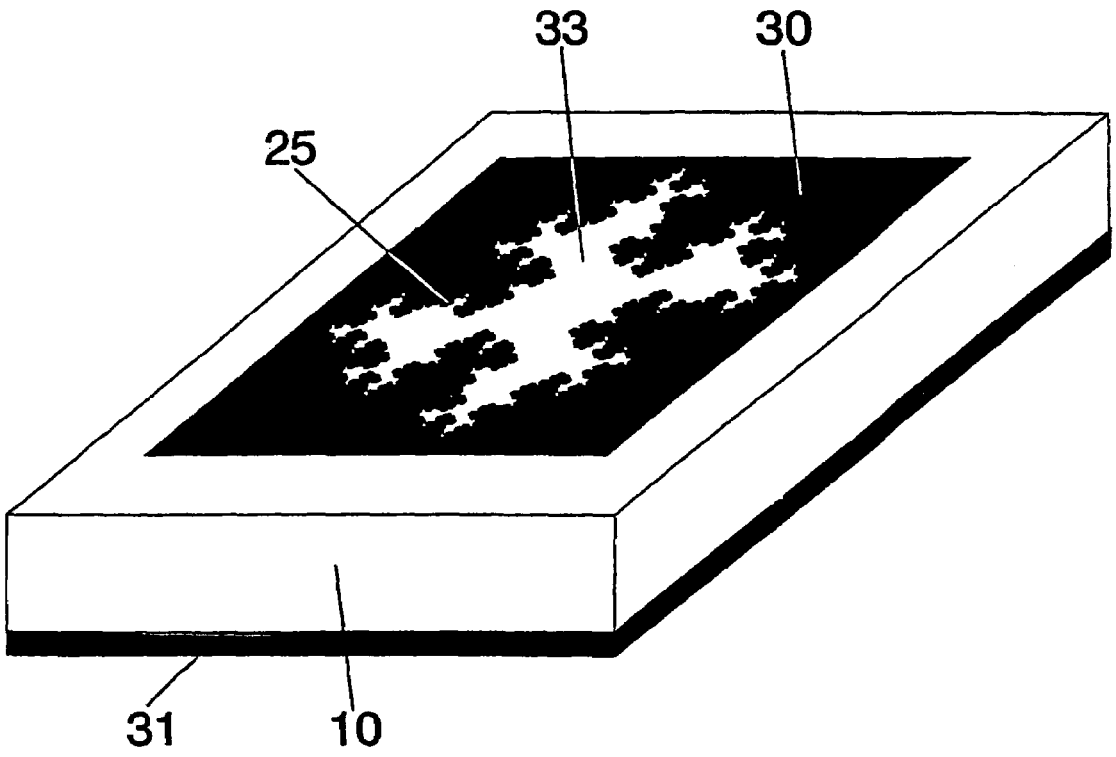
FIG. 13 shows a patch antenna with an aperture on the patch based on SFC (25).
Figure 14:
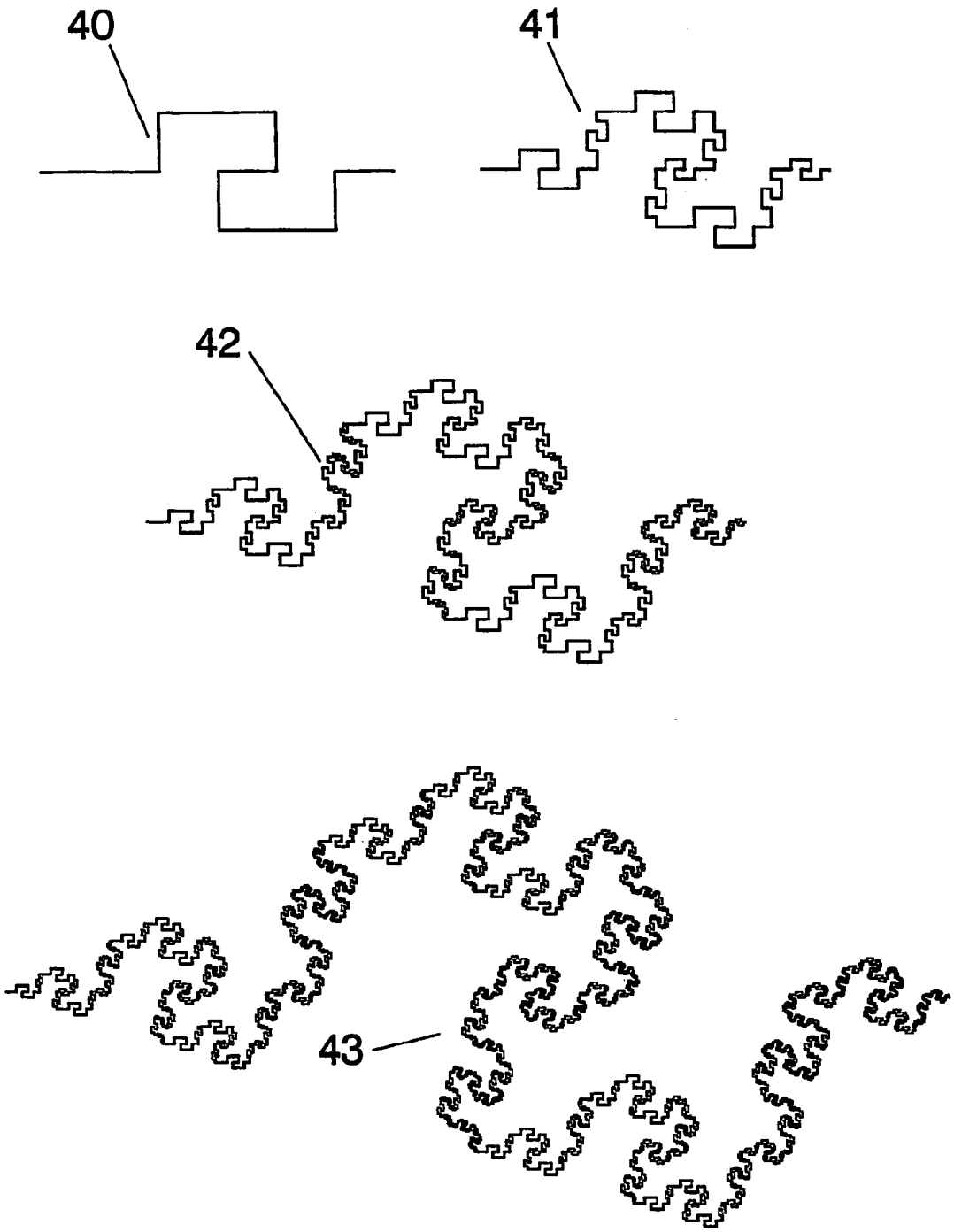
FIG. 14 shows another particular example of a family of SFC curves (41, 42, 43) based on the Giusepe Peano curve. A non-SFC curve formed with only 9 segments is shown for comparison.
Figure 15:
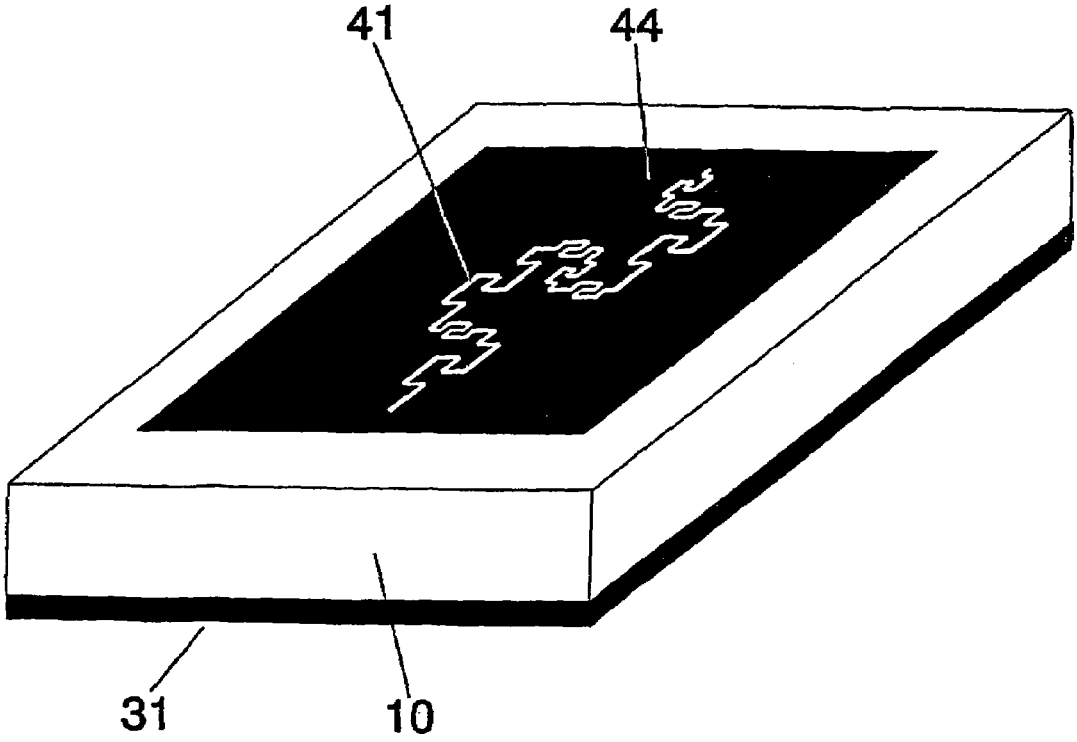
FIG. 15 shows a patch antenna with an SFC slot based on SFC (41).

Other preferred embodiments of SFC antennas based also on the patch configuration are disclosed in FIG. 13 and FIG. 15. They consist on a conventional patch antenna with a polygonal patch (30) (squared, triangular, pentagonal, hexagonal, rectangular, or even circular, to name just a few examples), with an SFC curve shaping a gap on the patch. Such an SFC line can form an slot or spur-line (44) over the patch (as seen in FIG. 15) contributing this way in reducing the antenna size and introducing new resonant frequencies for a multiband operation, or in another preferred embodiment the SFC curve (such as (25) defines the perimeter of an aperture (33) on the patch (30) (FIG. 13). Such an aperture contributes significantly to reduce the first resonant frequency of the patch with respect to the solid patch case, which significantly contributes to reducing the antenna size. Said two configurations, the SFC slot and the SFC aperture cases can of course be use also with SFC perimeter patch antennas as for instance the one (30) described in FIG. 11.

At this point it becomes clear to those skilled in the art what is the scope and spirit of the present invention and that the same SFC geometric principle can be applied in an innovative way to all the well known, prior art configurations. More examples are given in FIGS. 12, 16, 17 and 18.

Figure 12:
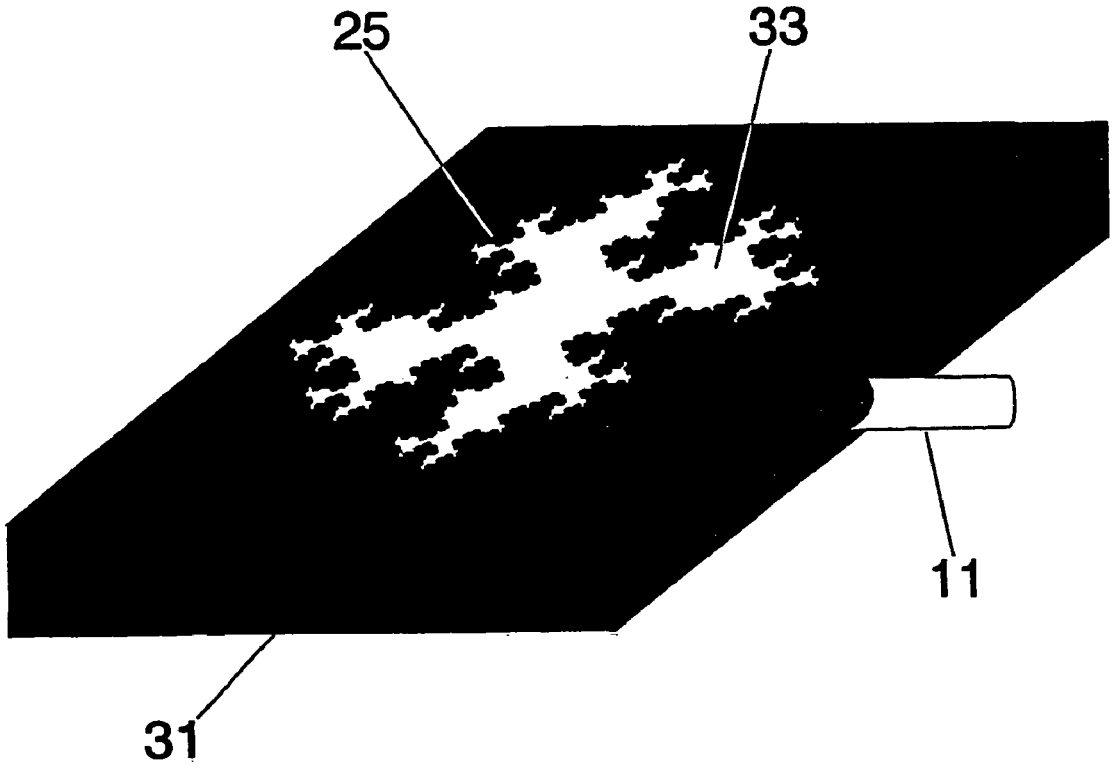
FIG. 12 shows an aperture antenna wherein the aperture (33) is practiced on a conducting or superconducting structure (31), said aperture being shaped with SFC (25).

FIG. 12 describes another preferred embodiment of an SFC antenna. It consists on an aperture antenna, said aperture being characterized by its SFC perimeter, said aperture being impressed over a conducting ground-plane or ground-counterpoise (34), said ground-plane of ground-counterpoise consisting, for example, on a wall of a waveguide or cavity resonator or a part of the structure of a motor vehicle (such as a car, a lorry, an airplane or a tank). The aperture can be fed by any of the conventional techniques such as a coaxial cable (11), or a planar microstrip or strip-line transmission line, to name a few.

Figure 16:
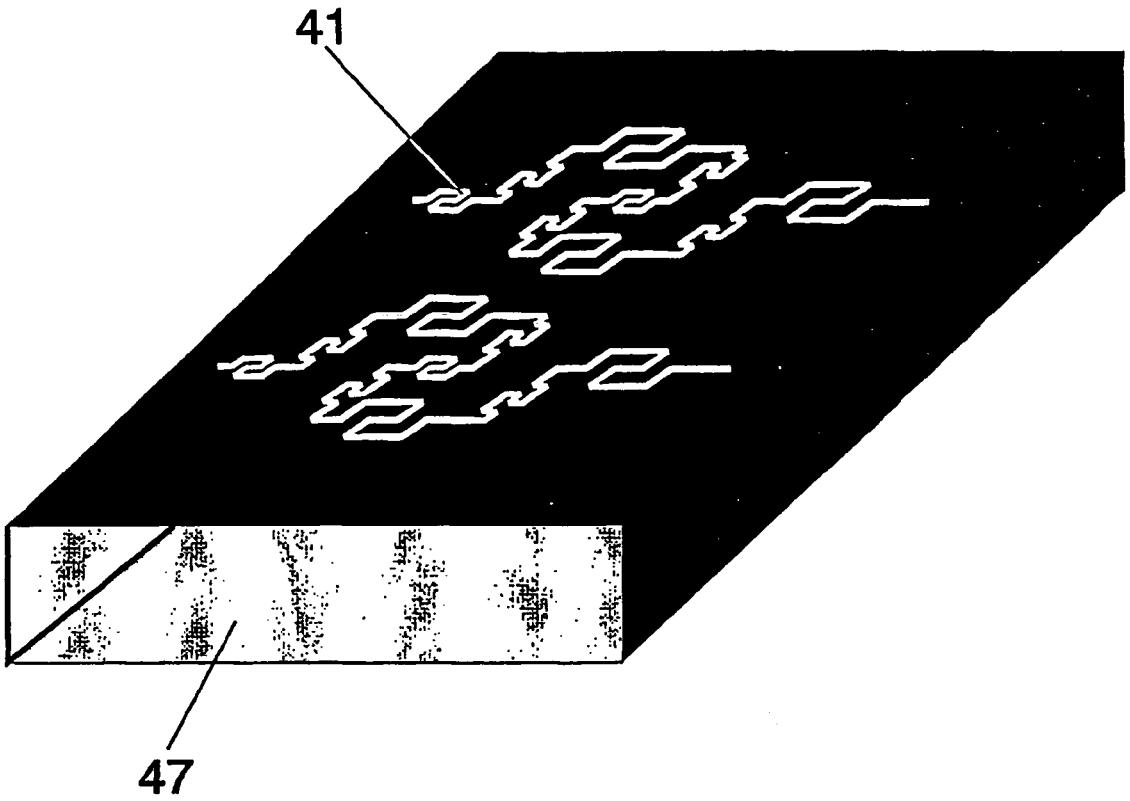
FIG. 16 shows a wave-guide slot antenna wherein a rectangular waveguide (47) has one of its walls slotted with SFC curve (41).

FIG. 16 shows another preferred embodiment where the SFC curves (41) are slotted over a wall of a waveguide (47) of arbitrary cross-section. This way and slotted waveguide array can be formed, with the advantage of the size compressing properties of the SFC curves.

Figure 17:
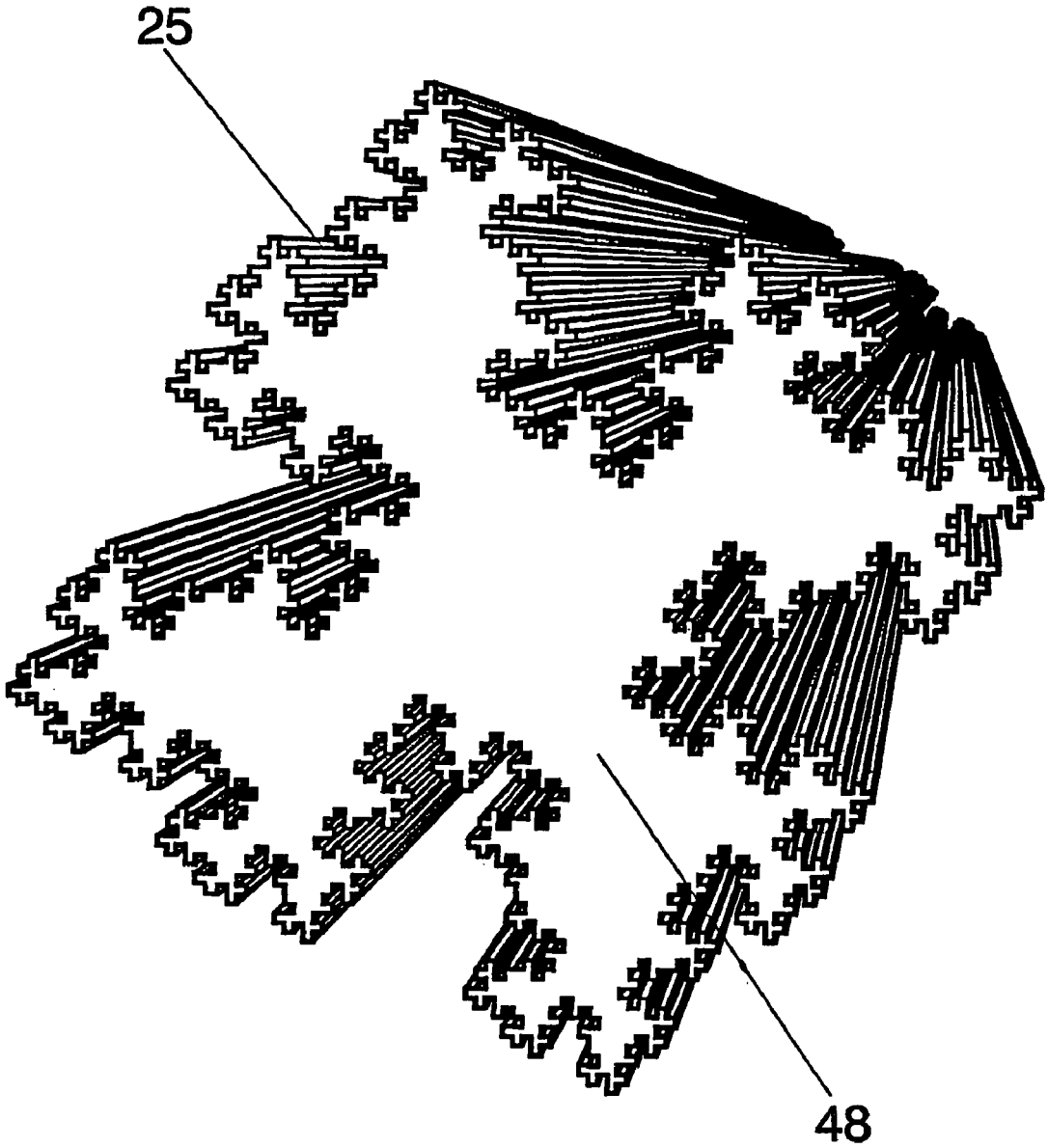
FIG. 17 shows a horn antenna, wherein the aperture and cross-section of the horn is shaped after SFC (25).

FIG. 17 depicts another preferred embodiment, in this case a horn antenna (48) where the cross-section of the antenna is an SFC curve (25). In this case, the benefit comes not only from the size reduction property of SFC geometries, but also from the broadband behavior that can be achieved by shaping the horn cross-section. Primitive versions of these techniques have been already developed in the form of Ridge horn antennas. In said prior art cases, a single squared tooth introduced in at least two opposite walls of the horn is used to increase the bandwidth of the antenna. The richer scale structure of an SFC curve further contributes to a bandwidth enhancement with respect to prior art.

Figure 18:
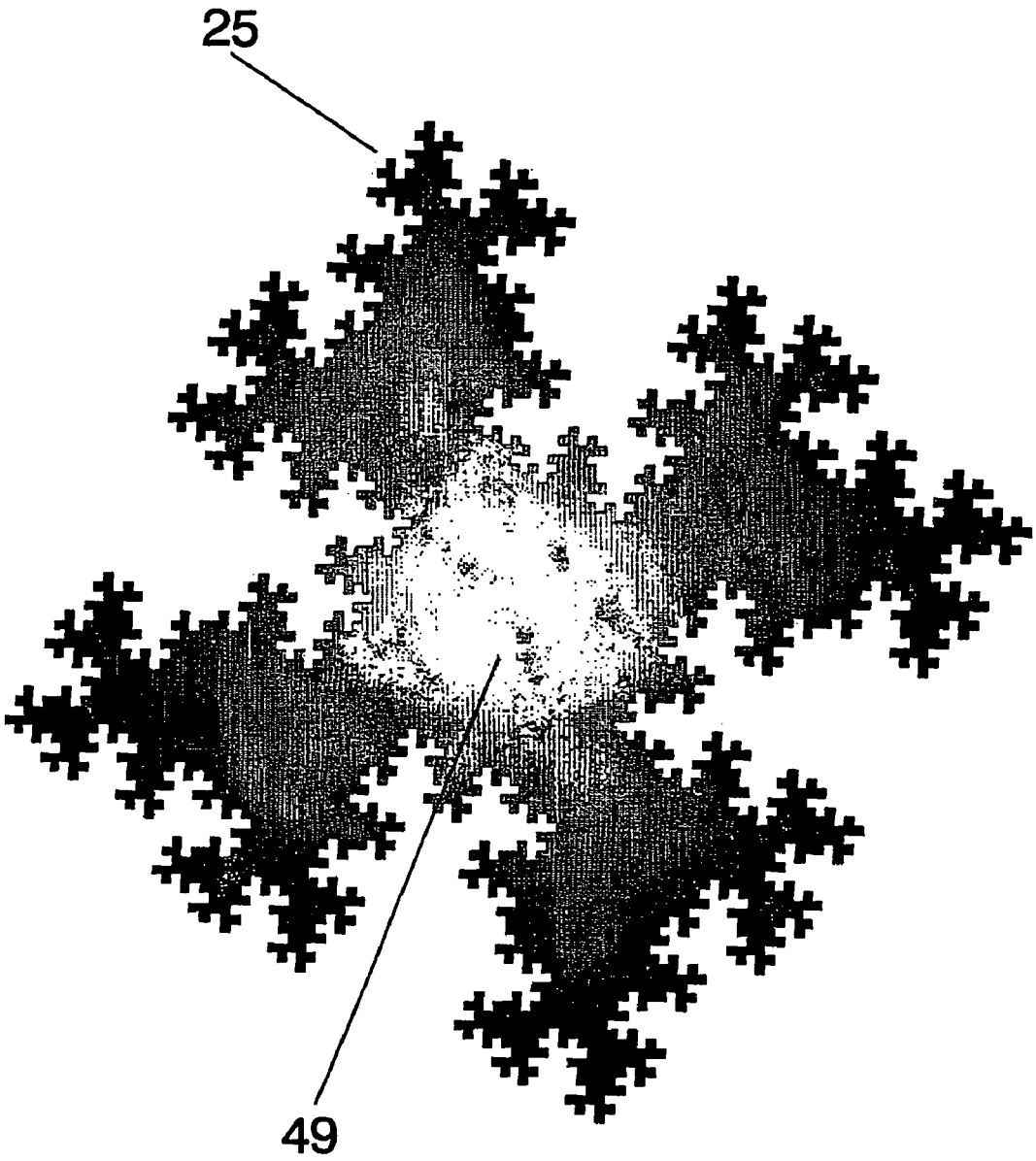
FIG. 18 shows a reflector of a reflector antenna wherein the perimeter of said reflector is shaped as SFC (25).
Figure 19:
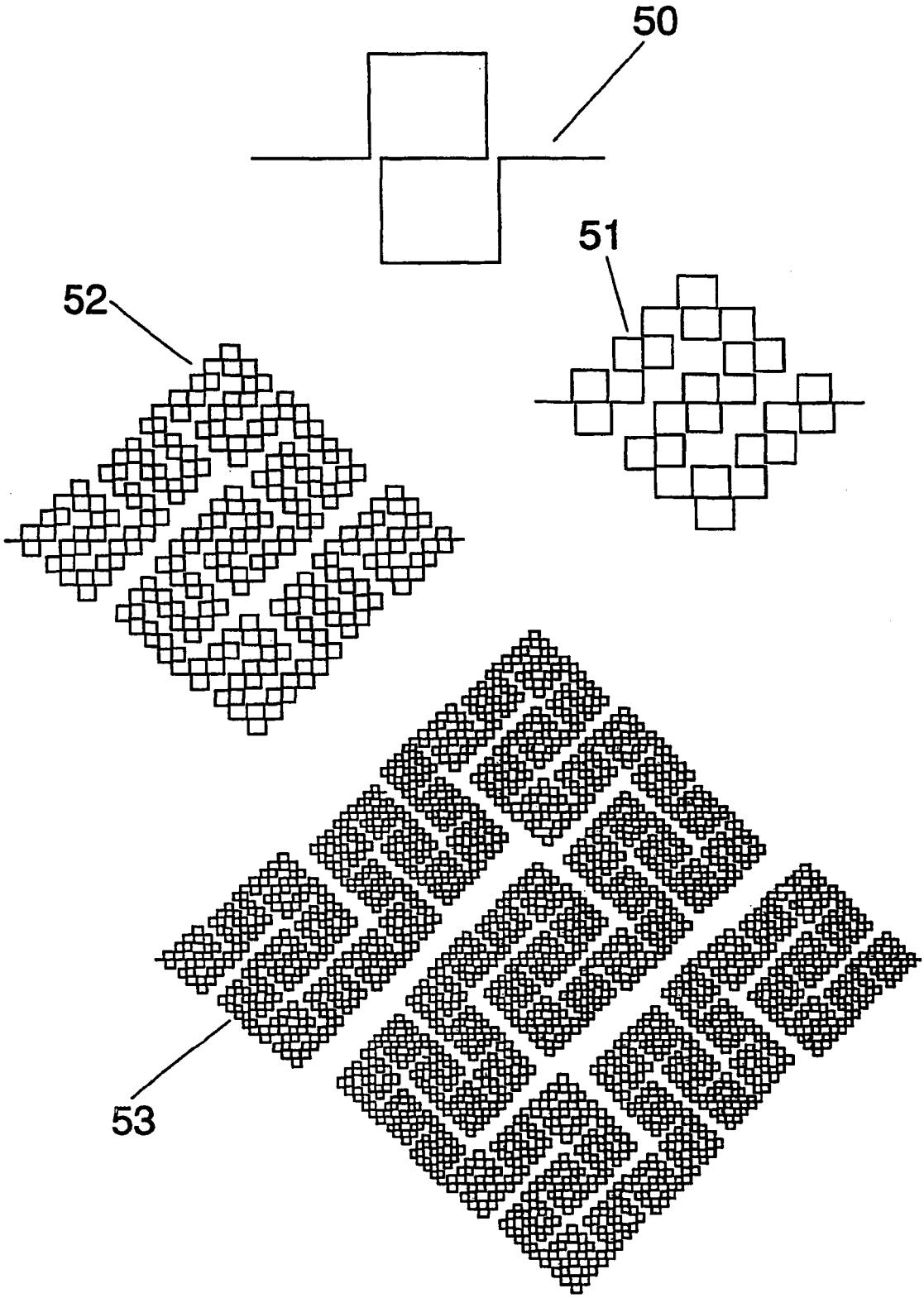
FIG. 19 shows a family of SFC curves (51, 52, 53) based on the Giusepe Peano curve. A non-SFC curve formed with only nine segments is shown for comparison (50).
Figure 20:
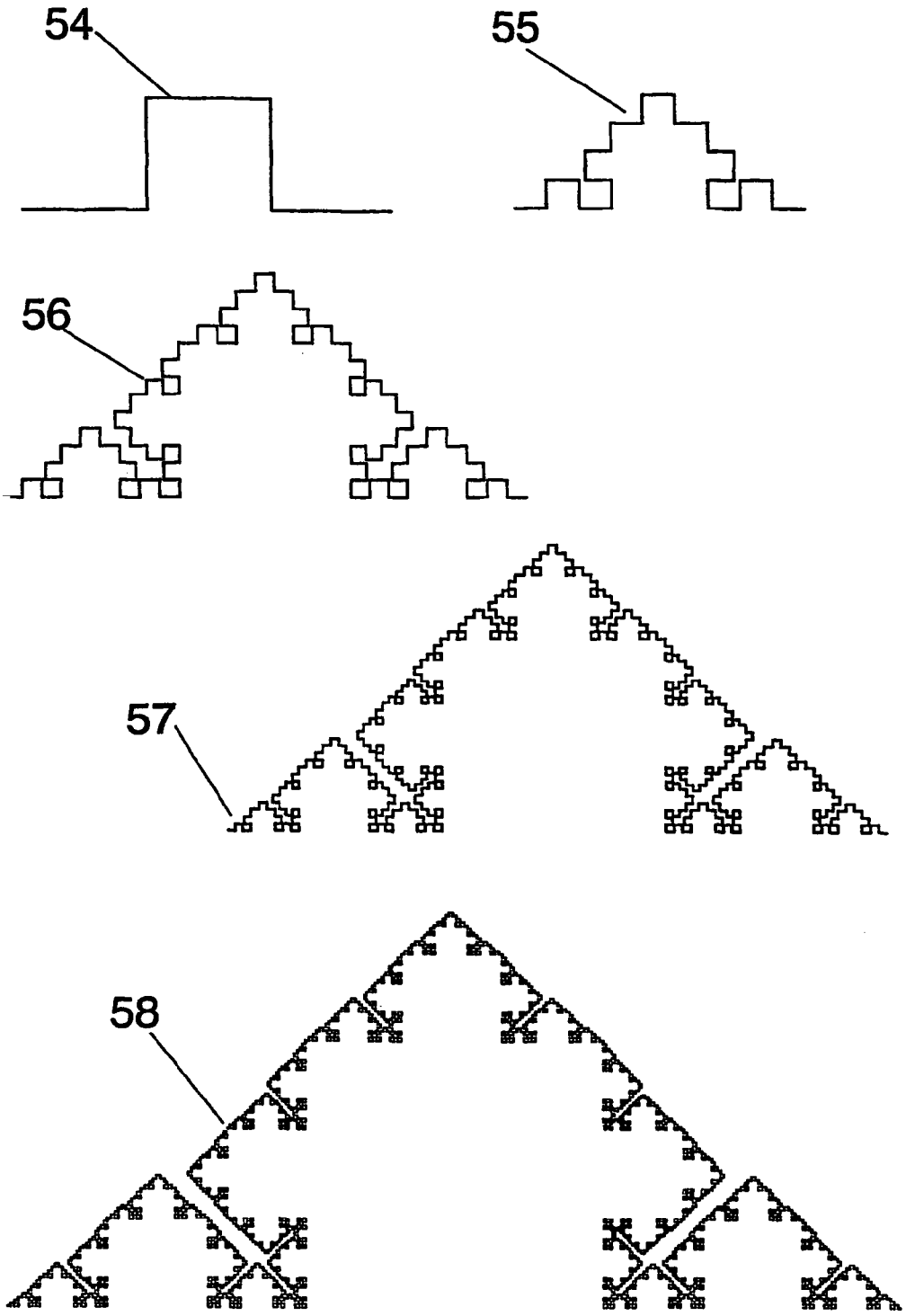
FIG. 20 shows another family of SFC curves (55, 56, 57, 58). A non-SFC curve (54) constructed with only five segments is shown for comparison.
Figure 21:
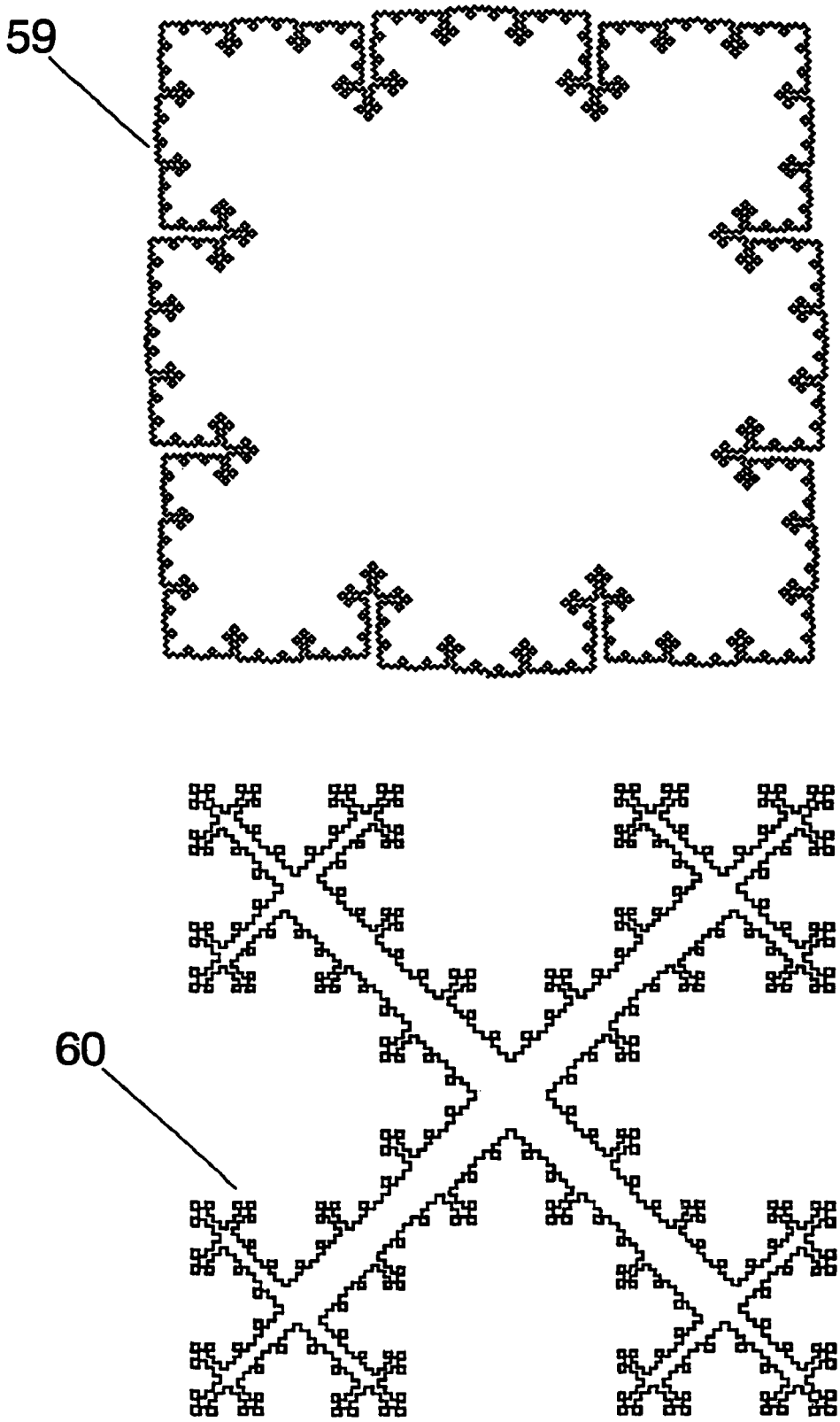
FIG. 21 shows two examples of SFC loops (59, 60) constructed with SFC (57).
Figure 22:
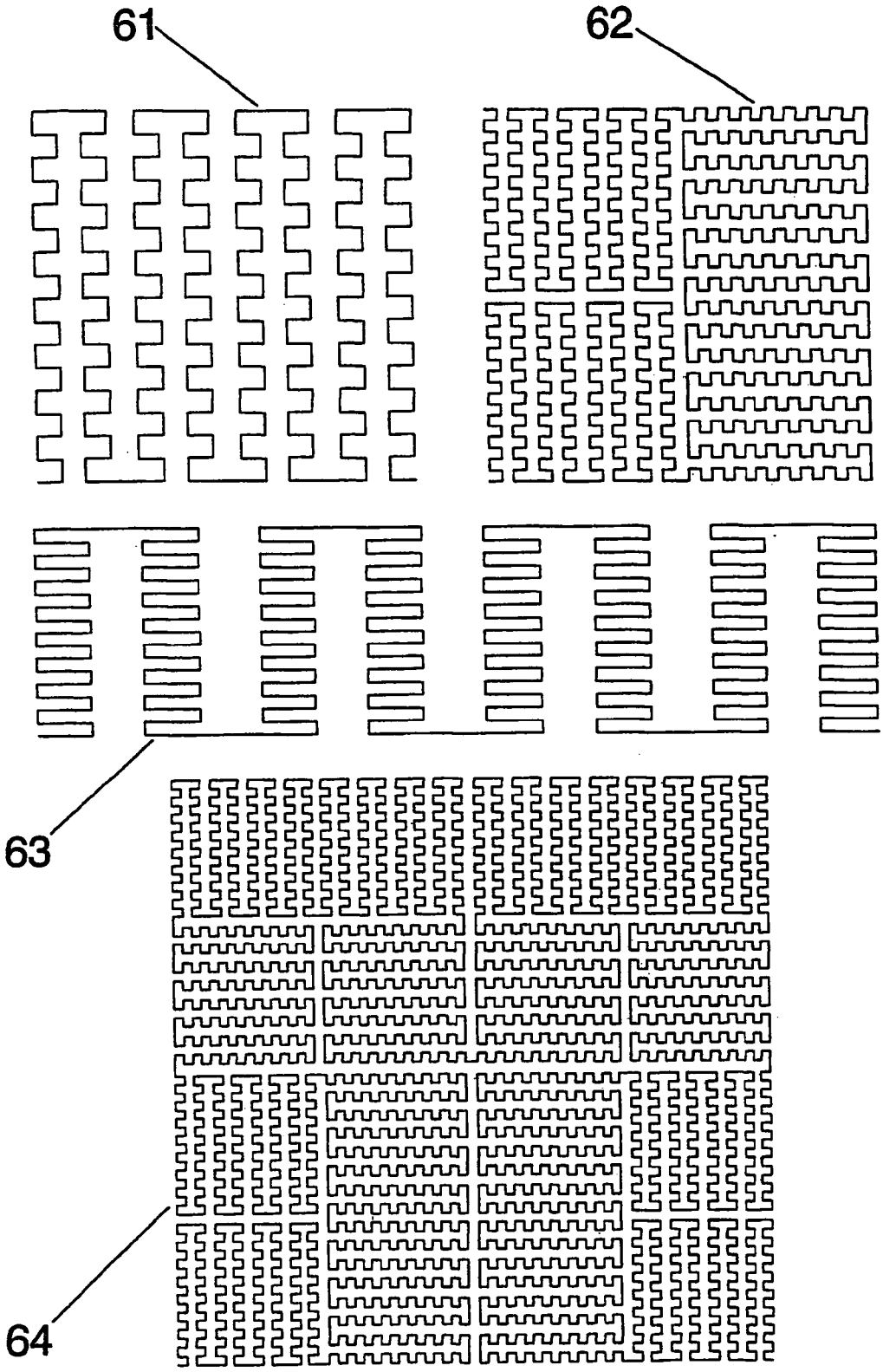
FIG. 22 shows a family of SFC curves (61, 62, 63, 64) named here as HilbertZZ curves.
Figure 23:
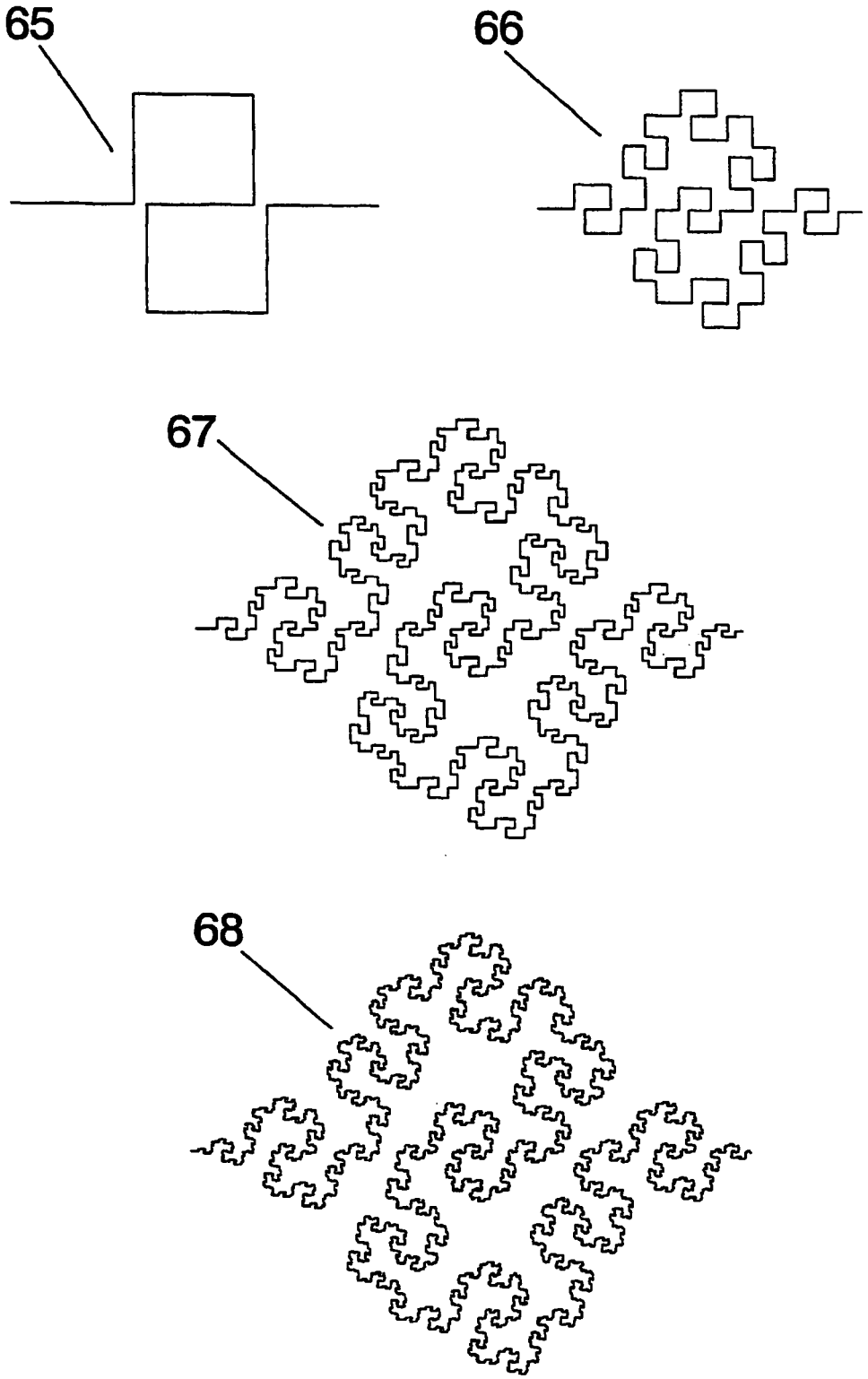
FIG. 23 shows a family of SFC curves (66, 67, 68) named here as Peanodec curves. A non-SFC curve (65) constructed with only nine segments is shown for comparison.
Figure 24:
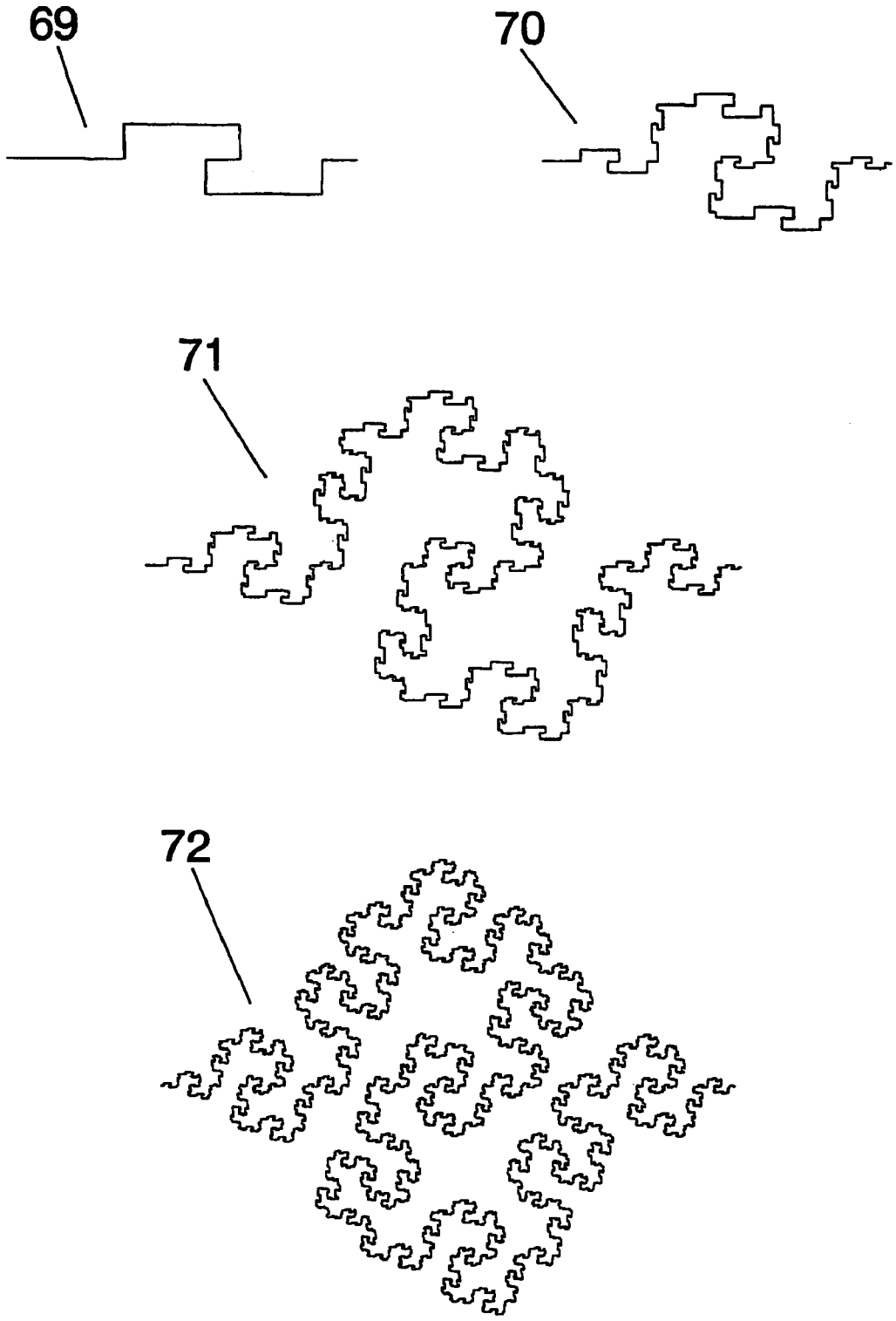
FIG. 24 shows a family of SFC curves (70, 71, 72) named here as Peanoinc curves. A non-SFC curve (69) constructed with only nine segments is shown for comparison.
Figure 25:
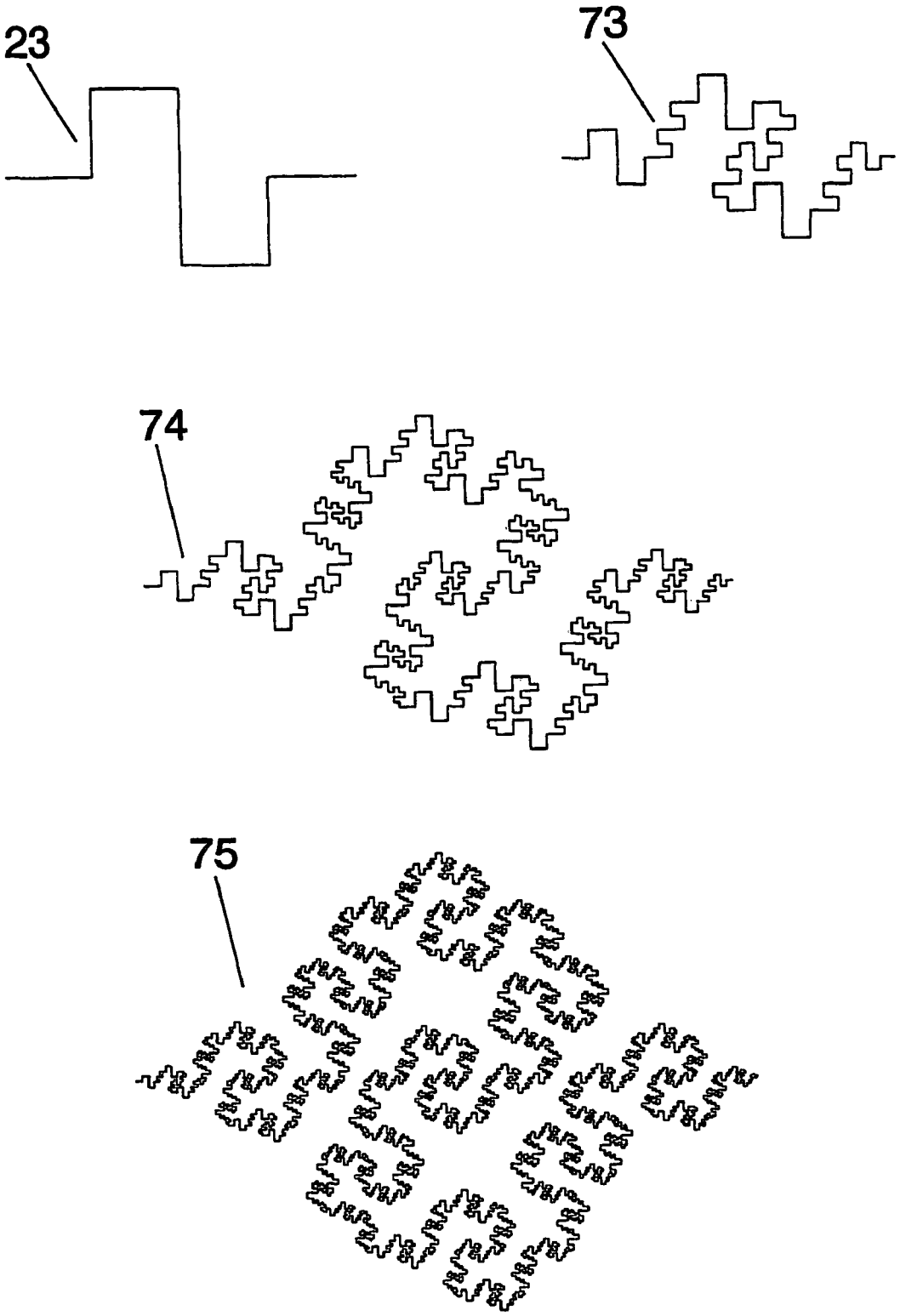
FIG. 25 shows a family of SFC curves (73, 74, 75) named here as PeanoZZ curves. A non-SFC curve (23) constructed with only nine segments is shown for comparison.

FIG. 18 describes another typical configuration of antenna, a reflector antenna (49), with the newly disclosed approach of shaping the reflector perimeter with an SFC curve. The reflector can be either flat or curved, depending on the application or feeding scheme (in for instance a reflectarray configuration the SFC reflectors will preferably be flat, while in focus fed dish reflectors the surface bounded by the SFC curve will preferably be curved approaching a parabolic surface). Also, within the spirit of SFC reflecting surfaces, Frequency Selective Surfaces (FSS) can be also constructed by means of SFC curves; in this case the SFC are used to shape the repetitive pattern over the FSS. In said FSS configuration, the SFC elements are used in an advantageous way with respect to prior art because the reduced size of the SFC patterns allows a closer spacing between said elements. A similar advantage is obtained when the SFC elements are used in an antenna array in an antenna reflectarray.

Figure 26:
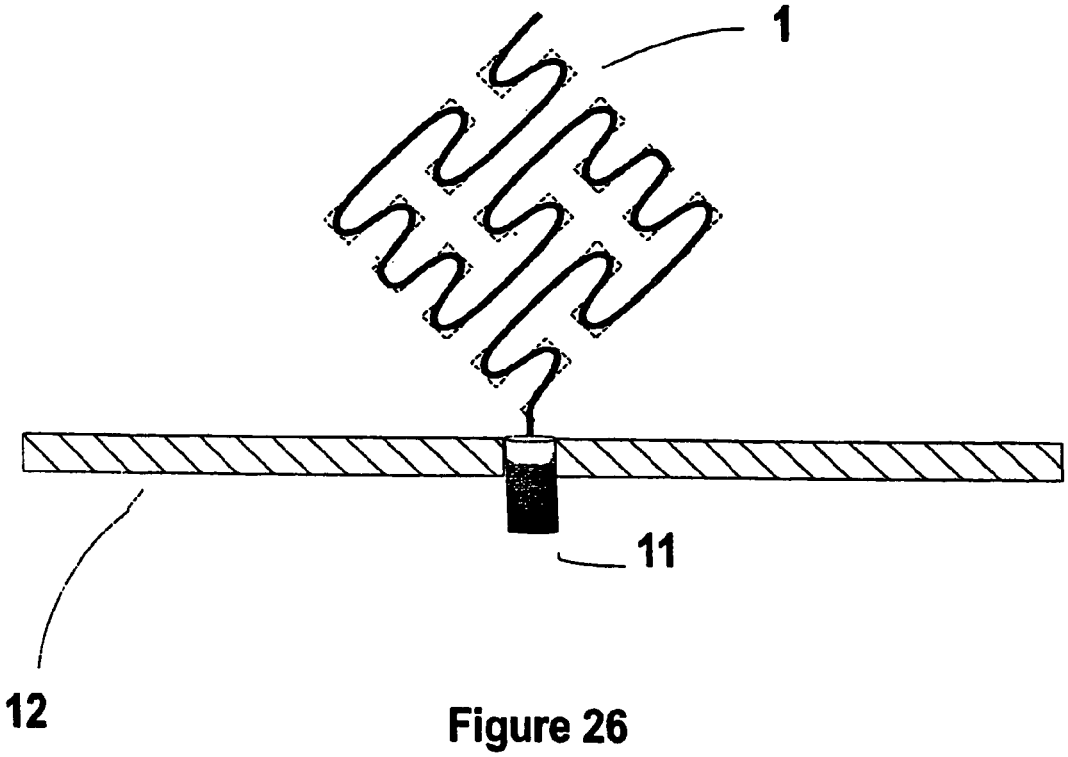
FIGS. 26 and 27 show two examples of space-filling curves in which the corners formed by each pair of adjacent segments are rounded.
Figure 27:
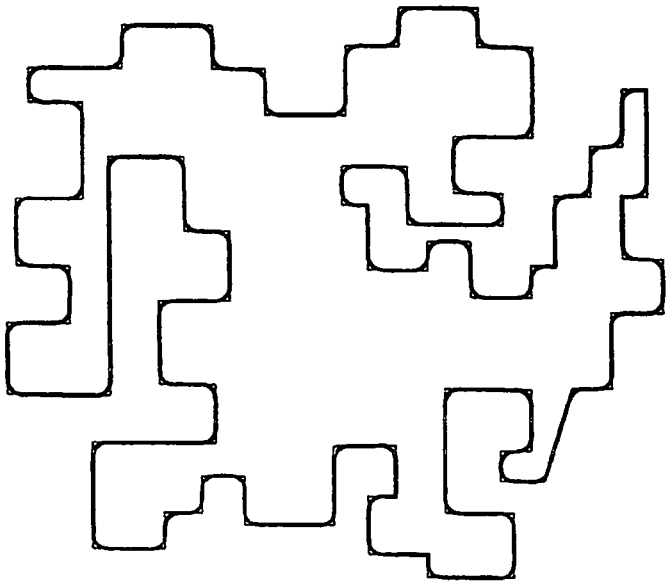

FIGS. 26 and 27 show two examples of space-filling curves in which the corners formed by each pair of adjacent segments are rounded.

Having illustrated and described the principles of our invention in several preferred embodiments thereof, it should be readily apparent to those skilled in the art that the invention can be modified in arrangement and detail without departing from such principles. We claim all modifications coming within the spirit and scope of the accompanying claims.

We claim:

1. An antenna in which at least one portion of the antenna is shaped as a space-filling curve (hereafter SFC), the SFC including at least ten connected straight segments, wherein said segments are each smaller than a tenth of the operating free-space wavelength of the antenna and the segments are spatially arranged such that no two adjacent and connected segments form another longer straight segment, wherein none of said segments intersect with another segment other than to form a closed loop, wherein each pair of adjacent segments forms a corner, and wherein any portion of the curve that is periodic along a fixed straight direction of space is defined by a non-periodic curve that includes at least ten connected segments in which no two adjacent and connected segments define a straight longer segment, wherein said SFC has a box-counting dimension larger than one, wherein the box-counting dimension is calculated as the slope of a straight portion of a log-log graph, wherein the straight portion is a straight segment over at least an octave of scales on the horizontal axes of the log-log graph.

2. An antenna according to claim 1, in which at least one portion of the antenna is shaped either as a Hilbert or a Peano curve.

3. An antenna according to claim 1, in which at least one portion of the antenna is shaped either as an SZ, ZZ, HilbertZZ, Peanoinc, Peanodec or PeanoZZ curve.

4. An antenna according to claim 1, wherein the antenna includes a network between an element and an input connector or transmission line, said network being either a matching network, an impedance transformer network, a balun network, a filter network, a diplexer network or a duplexer network.

5. An antenna according to claim 1, wherein the antenna is a dipole antenna comprising two conducting or superconducting arms in which at least a part of at least one of the arms of the dipole is shaped as a SFC.

6. An antenna according to claim 1, wherein the antenna is a monopole antenna comprising a radiating arm and a ground counterpoise in which at least a part of said radiating arm is shaped as a SFC.

7. An antenna according to claim 1, wherein the antenna is a slot antenna comprising at least a conducting or superconducting surface, wherein said surface includes a slot, wherein said slot is shaped as a SFC and wherein said slot is filled or backed by a dielectric substrate and wherein said conducting or superconducting surface including said slot is either a wall of a waveguide, a wall of a cavity resonator, a conducting film over a glass of a window in a motor vehicle, or part of a metallic structure of the motor vehicle.

8. An antenna according to claim 1, wherein the antenna is a loop antenna comprising a conducting or superconducting wire wherein at least a portion of the wire forming the loop is shaped as a SFC.

9. An antenna according to claim 1, wherein the antenna is a loop antenna comprising a conducting or superconducting surface with a slot or gap loop impressed on said conducting or superconducting surface, wherein part of the slot or gap loop is shaped as a SFC.

10. An antenna according to claim 1, wherein the antenna is an aperture antenna comprising at least a conducting or superconducting surface and an aperture on said surface wherein a perimeter of the aperture is shaped as a SFC and wherein said conducting or superconducting surface including the aperture or slot is either a wall of a waveguide, a wall of a cavity resonator, a transparent conducting film over a glass of a window in a motor vehicle, or part of a metallic structure of the motor vehicle, wherein said slot is filled or backed by a dielectric substrate.

11. An antenna according to claim 1, wherein the antenna is a horn antenna in which a cross-section of the horn is shaped as a SFC.

12. An antenna according to claim 1, wherein the antenna is a reflector antenna in which a perimeter of the reflector is shaped as a SFC.

13. A plurality of antennas according to claim 1, wherein at least two of the antennas of said plurality of antennas operate at different frequencies to provide coverage to different communications services, wherein said plurality of antennas can be simultaneously fed by means of a distribution or diplexer network.

14. The antenna of claim 1, wherein the corners formed by each pair of adjacent segments are angular.

15. The antenna of claim 1, wherein the corners formed by each pair of adjacent segments are curved.

16. The antenna of claim 1, wherein the space-filling curve is printed over a dielectric substrate.

17. An antenna of claim 1, wherein the box-counting dimension of the antenna is about 2.

18. An antenna in which at least one portion of the antenna is shaped as a space-filling curve (hereafter SFC), the SFC including at least ten connected straight segments, wherein said segments are each smaller than a tenth of the operating free-space wavelength of the antenna and the segments are spatially arranged such that no two adjacent and connected segments form another longer straight segment, wherein none of said segments intersect with another segment other than to form a closed loop, wherein each pair of adjacent segments forms a corner, and wherein any portion of the curve that is periodic along a fixed straight direction of space is defined by a non-periodic curve that includes at least ten connected segments in which no two adjacent and connected segments define a straight longer segment, wherein the antenna is a patch antenna comprising at least a conducting or superconducting ground-plane and a conducting or superconducting patch parallel to said ground-plane, in which the perimeter of the patch is shaped as a SFC.

19. An antenna according to claim 18, wherein the antenna is a patch antenna in which a slot or aperture on the patch antenna in which a slot or aperture on the patch is shaped as a SFC.

20. The antenna of claim 18, wherein the corners formed by each pair of adjacent segments are angular.

21. The antenna of claim 18, wherein the corners formed by each pair of adjacent segments are curved.

22. The antenna of claim 18, wherein the space-filling curve is printed over a dielectric substrate.

23. An antenna of claim 18, wherein the box-counting dimension of the antenna is about 2.

* * * * *